US011692547B2

(12) United States Patent
Park et al.

(10) Patent No.: US 11,692,547 B2
(45) Date of Patent: Jul. 4, 2023

(54) HERMETIC COMPRESSOR HAVING OIL GUIDE THAT SURROUNDS ROTATING SHAFT

(71) Applicant: LG Electronics Inc., Seoul (KR)

(72) Inventors: Junghoon Park, Seoul (KR); Sungyong Ahn, Seoul (KR); Taekyoung Kim, Seoul (KR); Seheon Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/696,236

(22) Filed: Mar. 16, 2022

(65) Prior Publication Data

US 2022/0299024 A1 Sep. 22, 2022

(30) Foreign Application Priority Data

Mar. 19, 2021 (KR) ..... 10-2021-0036174

(51) Int. Cl.

| | |
|---|---|
| ***F04C 18/02*** | (2006.01) |
| ***F04C 29/02*** | (2006.01) |
| ***F04C 23/00*** | (2006.01) |
| ***F04C 29/12*** | (2006.01) |

(52) U.S. Cl.

CPC ..... *F04C 18/0215* (2013.01); *F04C 23/008* (2013.01); *F04C 29/02* (2013.01); *F04C 29/12* (2013.01); *F04C 2240/30* (2013.01); *F04C 2240/40* (2013.01); *F04C 2240/50* (2013.01); *F04C 2240/60* (2013.01)

(58) Field of Classification Search

CPC ..... F04C 2/025; F04C 18/0207–0292; F04C 15/0088; F04C 15/0092; F04C 29/02–028; F01C 21/04; F01C 21/045

See application file for complete search history.

(56) References Cited

U.S. PATENT DOCUMENTS

| | | | | |
|---|---|---|---|---|
| 2006/0127262 | A1* | 6/2006 | Shin | F04C 29/0021 418/55.6 |
| 2007/0140885 | A1 | 6/2007 | Suh et al. | |
| 2008/0175738 | A1* | 7/2008 | Jung | F04C 18/0215 418/55.6 |

FOREIGN PATENT DOCUMENTS

| | | |
|---|---|---|
| EP | 1956244 | 8/2008 |
| JP | 2003293955 | 10/2003 |
| JP | 2012207541 | 10/2012 |
| JP | 2020531728 | 11/2020 |
| KR | 100686747 | 2/2007 |

(Continued)

OTHER PUBLICATIONS

Office Action in Korean Appln. No. 10-2021-0036174, dated Mar. 25, 2022, 14 pages (with English translation).

(Continued)

*Primary Examiner* — Laert Dounis

(74) *Attorney, Agent, or Firm* — Fish & Richardson P.C.

(57) ABSTRACT

A hermetic compressor according to the present disclosure may include an oil guide disposed on a rotating shaft between a driving motor and a main frame, the oil guide may include an oil block surrounding a main bearing surface between the main frame and the rotating shaft, and one end of the oil block may radially overlap a shaft support protrusion of the main frame. This can suppress oil returned after lubricating a compression unit from being scattered, thereby reducing a leakage of the oil to outside of a casing through a refrigerant discharge pipe.

19 Claims, 20 Drawing Sheets

(56) References Cited

FOREIGN PATENT DOCUMENTS

| | | | | | |
|---|---|---|---|---|---|
| KR | 20090013042 | | | 2/2009 | |
| KR | 20090095377 | A | * | 9/2009 | |
| WO | WO-2004081384 | A1 | * | 9/2004 | ..... F04B 39/023 |
| WO | WO-2018130134 | A1 | * | 7/2018 | ..... F04C 29/02 |

OTHER PUBLICATIONS

Extended European Search Report in European Appln. No. 22162843.1, dated Sep. 28, 2022, 7 pages.

* cited by examiner

HERMETIC COMPRESSOR HAVING OIL GUIDE THAT SURROUNDS ROTATING SHAFT

CROSS-REFERENCE TO RELATED APPLICATION

Pursuant to 35 U.S.C. § 119(a), this application claims the benefit of the earlier filing date and the right of priority to Korean Patent Application No. 10-2021-0036174, filed on Mar. 19, 2021, the contents of which are incorporated by reference herein in their entirety.

TECHNICAL FIELD

The present disclosure relates to a compressor, more particularly, a hermetic compressor.

BACKGROUND

In a hermetic compressor, a driving motor constituting a motor unit and a compression unit are installed together in an inner space of a casing. The hermetic compressor may be classified into a low-pressure type or a high-pressure type according to pressure of refrigerant filled in the inner space of the casing where the driving motor is disposed.

The low-pressure type is a compressor in which suction refrigerant is filled in the inner space of the casing to form suction pressure, and the high-pressure type is a compressor in which discharge refrigerant is filled in the inner space of the casing to form discharge pressure. Hereinafter, the inner space of the casing may be defined as a space in which the driving motor is installed unless otherwise specified.

In the low-pressure type compressor, the inner space of the casing is divided into a low-pressure part and a high-pressure part, such that a refrigerant suction pipe communicates with the low-pressure part where the driving motor is disposed and a refrigerant discharge pipe communicates with the high-pressure part. Accordingly, in the low-pressure compressor, the low-pressure part acts as a kind of accumulator, so that liquid refrigerant and oil can be separated from gas refrigerant suctioned into the inner space of the casing through the refrigerant suction pipe while the suctioned refrigerant passes through the low-pressure part.

In the high-pressure compressor, the refrigerant suction pipe communicates directly with a suction side of a compression chamber without communication with the inner space of the casing, and the inner space of the casing communicates with the refrigerant discharge pipe so that a discharge side of the compression chamber directly communicates with the refrigerant discharge pipe through the inner space of the casing. Accordingly, in the high-pressure compressor, refrigerant discharged from the compression unit passes through the inner space of the casing, and then flows toward a condenser of a refrigeration cycle through the refrigerant discharge pipe. At this time, the refrigerant is discharged from the compression unit in a mixed state with oil but the oil is separated from the refrigerant while the refrigerant passes through the inner space of the casing.

However, the refrigerant discharged from the compression unit quickly moves toward the refrigerant discharge pipe without circulating widely in the inner space of the casing. This may cause the oil without being separated from the refrigerant to flow to the refrigeration cycle through the refrigerant discharge pipe. This causes a friction loss due to insufficient oil in the compressor.

Patent Document 1 (Korean Patent Publication No. 10-2009-0013042) discloses an example in which an oil separator is separately installed outside a casing in a high-pressure compressor. The oil separator in Patent Document 1 is disposed in the middle of a refrigerant discharge pipe communicating with an inner space of the casing.

Accordingly, refrigerant discharged from a compression unit into the inner space of the casing partially flows into the oil separator connected to the refrigerant discharge pipe outside the casing to be separated into gas refrigerant and oil (liquid refrigerant). The gas refrigerant moves toward a condenser through a refrigerant pipe while the oil separated from the gas refrigerant is returned to an oil pump through an oil return pipe, thereby suppressing an oil leakage. However, in Patent Document 1, the addition of the separate oil separator at the outside of the casing may increase the number of parts, thereby increasing manufacturing costs.

Patent Document 2 (Korean Patent Registration No. 10-0686747) discloses an example in which an oil cap is disposed in a casing in a high-pressure compressor. Accordingly, refrigerant discharged from a compression unit to an inner space of the casing is moved down to a lower end of a driving motor by the oil cap and then discharged into a refrigerant discharge pipe through a driving motor, thereby suppressing an oil leakage.

However, in Patent Document 2, as an upper end of the oil cap is open, oil returned into the oil cap through a gap between a main frame and a rotating shaft moves directly to the refrigerant discharge pipe through the open upper end of the oil cap, which may reduce an oil separation effect in the inner space of the casing.

In addition, in the related art high-pressure compressor including Patent Document 1 and Patent Document 2, an inner end portion of the refrigerant discharge pipe is aligned in a communicating manner with or shallowly fitted into an inner circumferential surface of the casing. This defines a short and simple movement path of the refrigerant discharged from the compression unit, which may be disadvantageous in view of separating oil from the refrigerant.

In addition, in the related art high-pressure compressors including Patent Document 1 and Patent Document 2, even if the inner end portion of the refrigerant discharge pipe is deeply inserted into the casing, the inner end portion of the refrigerant discharge pipe is linearly inserted or only the inner end portion is open. This may define a large discharge passage in the refrigerant discharge pipe in one direction. As a result, oil flows out together with refrigerant without flow resistance, which may increase an oil leakage loss.

SUMMARY

The present disclosure describes a hermetic compressor capable of preventing oil stored in an inner space of a casing from flowing out of the casing through a refrigerant discharge pipe.

The present disclosure also describes a hermetic compressor capable of preventing an oil leakage by blocking oil returned to a compression unit through a main bearing surface defined between an outer circumferential surface of a rotating shaft and an inner circumferential surface of a main frame from moving toward a refrigerant discharge pipe.

The present disclosure further describes a hermetic compressor capable of blocking oil scattered from a main bearing surface by an oil block surrounding the main bearing surface so as to suppress the oil from flowing toward a refrigerant discharge pipe.

The present disclosure further describes a hermetic compressor capable of enhancing an oil separation effect in a casing by increasing flow resistance in a refrigerant discharge pipe.

The present disclosure further describes a hermetic compressor capable of increasing flow resistance by complicating a discharge passage of refrigerant flowing toward a discharge pipe.

In order to achieve the aspects of the subject matter disclosed herein, an oil cap may be disposed between a driving motor and a main frame and an oil block may be installed on an upper end of the oil cap. The oil block may be installed such that at least a portion thereof radially overlaps the main frame. This can suppress oil returned from the main frame to the driving motor from being scattered, thereby preventing an oil leakage.

In addition, in order to achieve the aspect of the subject matter disclosed herein, a refrigerant discharge pipe may be fitted between a driving motor and a main frame such that an inner end of the refrigerant discharge pipe axially overlaps a coil of the driving motor. This can make a discharge passage of refrigerant complicated, thereby effectively preventing an oil leakage.

In order to achieve the aspect of the subject matter disclosed herein, a refrigerant discharge pipe may be fitted between a driving motor and a main frame such that an inner accommodation portion of the refrigerant discharge pipe is curved or bent. This can make a discharge passage of refrigerant more complicated, thereby effectively preventing an oil leakage.

In order to achieve the aspect of the subject matter disclosed herein, a plurality of narrow refrigerant through holes or slits may be formed at a circumferential surface of an inner end portion of a refrigerant discharge pipe that is accommodated in an inner space of a casing. This can improve an oil separation effect while refrigerant passes through the narrow refrigerant through holes or slits.

Specifically, a hermetic compressor according to an implementation may include a casing, a driving motor, a rotating shaft, a compression unit, a main frame, a refrigerant suction pipe, a refrigerant discharge pipe, and an oil guide. The casing may have a hermetic inner space. The motor unit may be disposed in the inner space of the casing. The rotating shaft may be coupled to a rotor of the driving motor. The compression unit may be coupled to the rotating shaft and disposed in the inner space of the casing. The main frame may be disposed between the driving motor and the compression unit. A shaft support protrusion for supporting the rotating shaft may be formed in an annular shape and extend toward the driving motor. The refrigerant suction pipe may be coupled to the compression unit through the casing so as to communicate with the compression unit. The refrigerant discharge pipe may communicate with the inner space of the casing through the casing. The oil guide may have one end overlapping the shaft support protrusion of the main frame in a radial direction to surround a main bearing surface defined between the main frame and the rotating shaft. This can suppress oil returned after lubricating the compression unit from being scattered, thereby reducing a leakage of the oil to outside of the casing through the refrigerant discharge pipe.

In one example, the oil guide may include an oil block extending toward the main frame to surround the main bearing surface. The oil block may be formed such that an inner diameter at a side facing the driving motor is equal to an inner diameter at a side facing the main frame. This can facilitate manufacturing and assembling of the oil block.

In one example, the oil guide may include an oil block extending toward the main frame to surround the main bearing surface. The oil block may be formed such that an inner diameter at a side facing the driving motor is larger than an inner diameter at a side facing the main frame. This can allow oil scattered from the main bearing surface to be guided toward an oil storage space, thereby effectively reducing an oil leakage.

In another example, the oil block may further include an oil guide portion that is stepped or inclined on an edge of an inner circumferential side facing the driving motor. This can allow oil scattered from the main bearing surface to be guided more effectively toward the oil storage space.

In one example, the hermetic compressor may further include a balance weight disposed on the rotating shaft between the driving motor and the main frame. The oil guide may include an oil block fixed to the balance weight and extending toward the main frame to surround the main bearing surface. This can allow the oil block to be installed stably.

In another example, the balance weight may include a fixed mass portion formed in an annular shape and fixed to the rotating shaft, and an eccentric mass portion extending from the fixed mass portion to be eccentric in a radial direction. The oil block may be fixedly coupled to the eccentric mass portion. Accordingly, the oil block can be stably installed while being arranged close to the main bearing surface.

In another example, the oil block may have an inner diameter that is smaller than an outer diameter of the eccentric mass portion and larger than an outer diameter of the fixed mass portion. Accordingly, the oil block can be stably supported and oil can be smoothly returned to the oil storage space.

In one example, the hermetic compressor may further include a balance weight disposed on the rotating shaft between the driving motor and the main frame. The oil guide may include an oil cap accommodating the balance weight and extending toward the driving motor, and an oil block extending toward the main frame to surround the main bearing surface between the main frame and the rotating shaft. This can suppress oil returned through the main bearing surface from being introduced into the refrigerant discharge pipe, thereby reducing an oil leakage loss in the compressor.

In another example, the oil cap may include an oil guide portion accommodating the balance weight, and a cap fixing portion bent from an upper end of the oil guide portion to be fixed to the balance weight. The oil block may be disposed on an upper surface of the cap fixing portion and coupled to the balance weight together with the cap fixing portion. With the configuration, the oil block and the oil cap can be coupled by the same bolts, which can facilitate assembling between the oil block and the oil cap.

In another example, the cap fixing portion may have an inner diameter larger than or equal to an inner diameter of the oil block. With the configuration, flow resistance with respect to oil returned from a main bearing can be reduced, such that the oil can be smoothly returned into the oil storage space.

In another example, the oil cap may include an oil guide portion accommodating the balance weight, and a cap fixing portion bent from an upper end of the oil guide portion to be fixed to the balance weight. The oil block may integrally extend from the cap fixing portion. This can facilitate the formation of the oil block and reduce a weight of the oil guide, thereby enhancing motor efficiency.

In another example, the oil block may be bent from an inner circumference of the cap fixing portion and extend toward the main frame. This can reduce a gap between the oil block and the shaft support protrusion so as to minimize a leakage of returned oil to outside of the oil guide.

In one example, the oil guide may be formed in a cylindrical shape to surround the rotating shaft and be located between the refrigerant discharge pipe and the main bearing surface. The oil guide may have one end fixed to a lower surface of the main frame and extending toward the driving motor. This can more completely block the refrigerant discharge pipe and the main bearing surface from each other and simultaneously reduce a load of a rotating body, thereby enhancing motor efficiency.

In one example, the compression unit may include a refrigerant guide passage guiding refrigerant compressed in the compression unit to the inner space of the casing. An outlet-side end of the refrigerant guide passage may communicate with a space in which the refrigerant discharge pipe is accommodated. The refrigerant discharge pipe may be configured such that an inner end thereof accommodated in the inner space of the casing is located closer to the rotating shaft than the outlet-side end of the refrigerant guide passage or at the same distance as the outlet-side end from the rotating shaft. With the configuration, a discharge passage of refrigerant, which is discharged from the compression unit and moves adjacent to an inner circumferential surface of the casing, can be complicated. This can make the refrigerant circulate for an extended time in the inner space of the casing, thereby improving an oil separation effect.

In one example, an inner end of the refrigerant discharge pipe may axially overlap a stator coil disposed in the driving motor between the driving motor and the main frame. Accordingly, the inner end of the refrigerant discharge pipe can be located far from a refrigerant guide passage adjacent to the inner circumferential surface of the casing, thereby making the discharge passage of the refrigerant complicated.

In one example, the inner end of the refrigerant discharge pipe may face an axial center of the rotating shaft in the inner space of the casing. This may facilitate assembling of the refrigerant discharge pipe.

In one example, the inner end of the refrigerant discharge pipe may be disposed to face an eccentric direction with respect to the axial center of the rotating shaft between the driving motor and the main frame. This can facilitate assembling of the refrigerant discharge pipe and make the discharge passage of the refrigerant complicated, thereby improving an oil separation effect.

In another example, the refrigerant discharge pipe may be bent to be curved or inclined along a rotating direction of the rotating shaft between the driving motor and the main frame. This can delay an introduction of refrigerant into the refrigerant discharge pipe while the refrigerant flows in a circumferential direction in the inner space of the casing, thereby smoothly separating oil from the refrigerant.

DETAILED DESCRIPTION

Description will now be given in detail of a hermetic compressor according to one implementation disclosed herein, with reference to the accompanying drawings.

As described above, a hermetic compressor is configured such that a driving motor constituting a motor unit and a compression unit are installed together in an inner space of a casing, and may be classified into a low-pressure type or a high-pressure type according to pressure of refrigerant filled in the inner space of the casing where the driving motor is disposed.

In the high-pressure hermetic compressor, refrigerant discharged from the compression unit does not move directly to a refrigerant discharge pipe but circulates as long as possible in the inner space of the casing and then moves to the refrigerant discharge pipe, thereby suppressing an oil leakage. On the other hand, oil that has lubricated the compression unit is returned to an oil storage space of the casing as quick as possible, so as to be prevented from being discharged together with refrigerant circulating in the inner space of the casing.

This implementation relates to an oil leakage suppressing device that suppresses oil stored in the inner space of the casing from flowing out through a refrigerant discharge pipe in a high-pressure type hermetic compressor. Hereinafter, a high-pressure type scroll compressor will be described as an example. However, the oil leakage suppressing device according to the implementation is not applied only to the scroll compressor. For example, it may also be applied to a rotary compressor in which a compression unit includes a roller and a vane.

In addition, high-pressure type scroll compressors may be classified into a top-compression type and a bottom-compression type according to an installation position of a compression unit. The top-compression type includes a compression unit disposed above a driving motor while the bottom-compression type includes a compression unit disposed below a driving motor. This implementation will be described based on a top-compression type scroll compressor.

Figure 1:
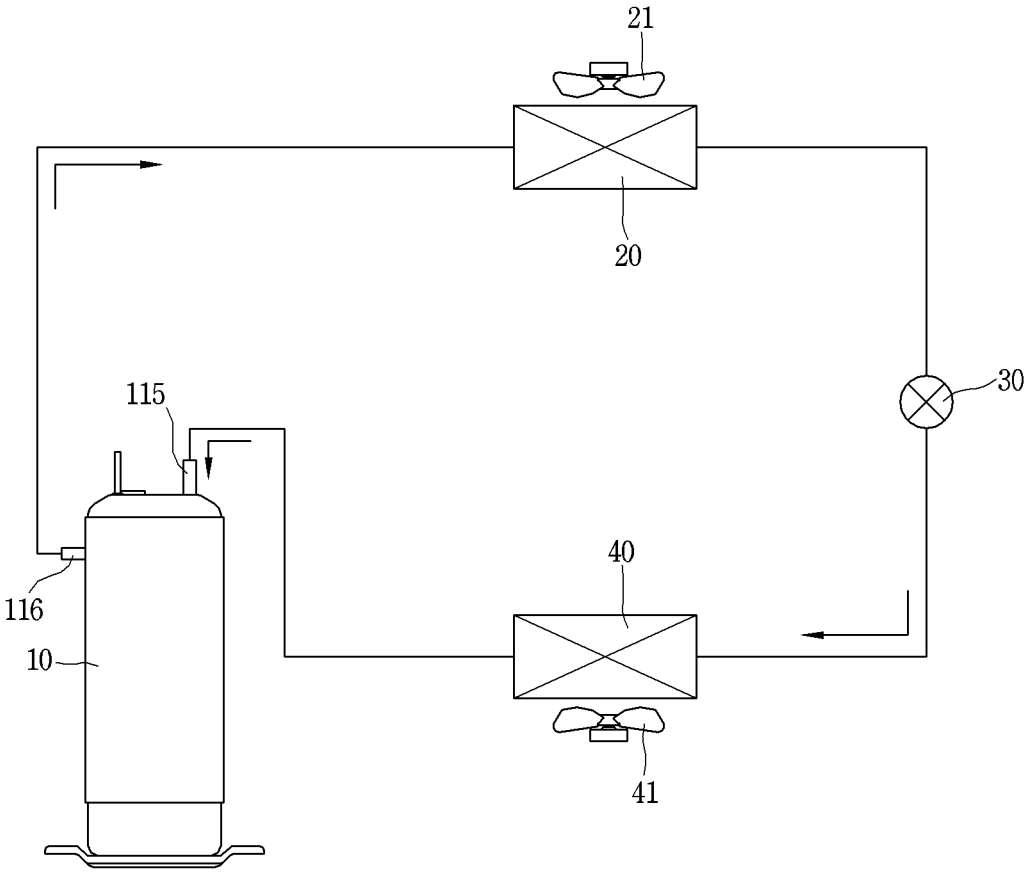
FIG. 1 is a schematic view illustrating a refrigeration cycle apparatus to which a top-compression type scroll compressor according to an implementation is applied.

FIG. 1 is a schematic view illustrating a refrigeration cycle apparatus to which a top-compression type scroll compressor according to an implementation is applied.

Referring to FIG. 1, a refrigeration cycle apparatus to which the scroll compressor according to the implementation is applied may be configured such that a compressor 10, a condenser 20, an expansion apparatus 30, and an evaporator 40 define a closed loop. The condenser 20, the expansion apparatus 30, and the evaporator 40 may be sequentially connected to a discharge side of the compressor 10 and a discharge side of the evaporator 40 may be connected to a suction side of the compressor 10.

Accordingly, refrigerant compressed in the compressor 10 may be discharged toward the condenser 20, and then sucked back into the compressor 10 sequentially through the expansion apparatus 30 and the evaporator 40. The series of processes may be repeatedly carried out.

Figure 2:
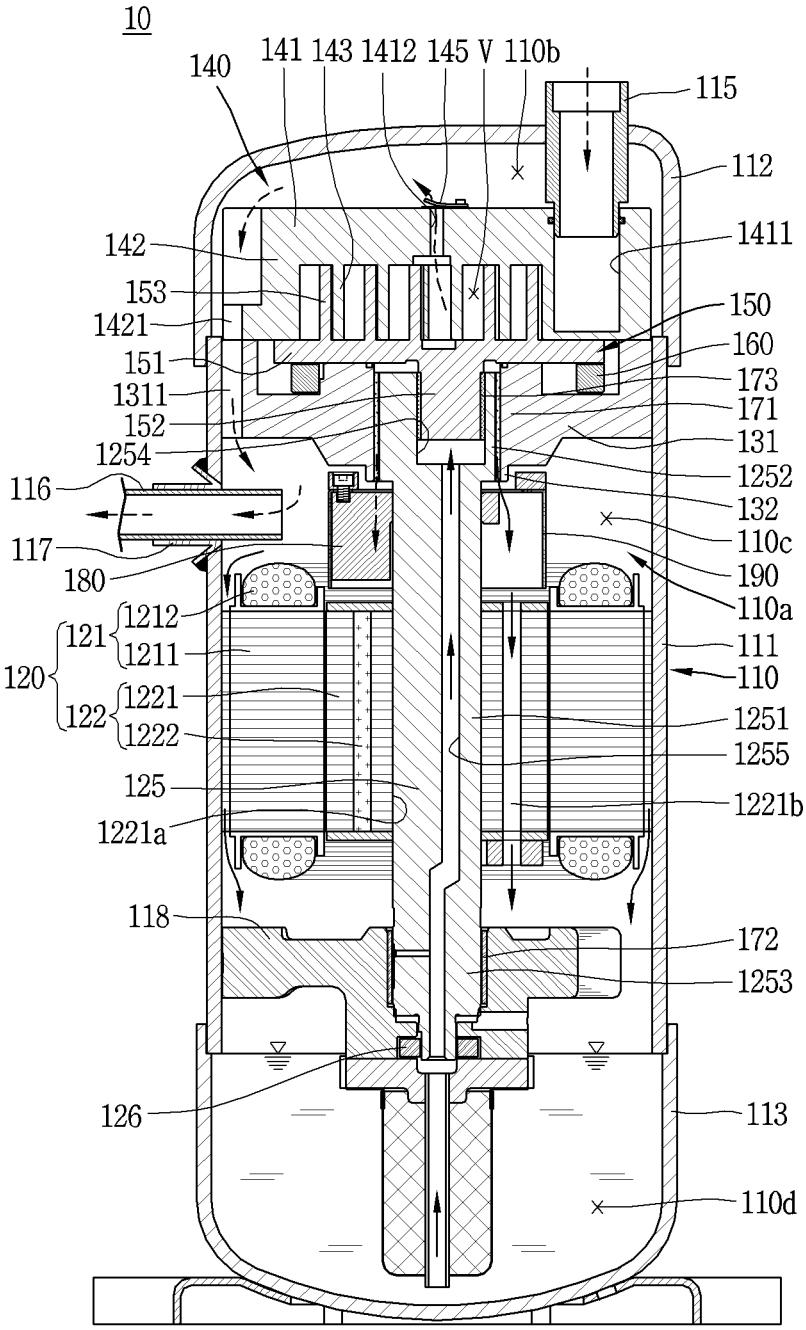
FIG. 2 is a cross-sectional view of a top-compression type scroll compressor in accordance with an implementation.
Figure 3:
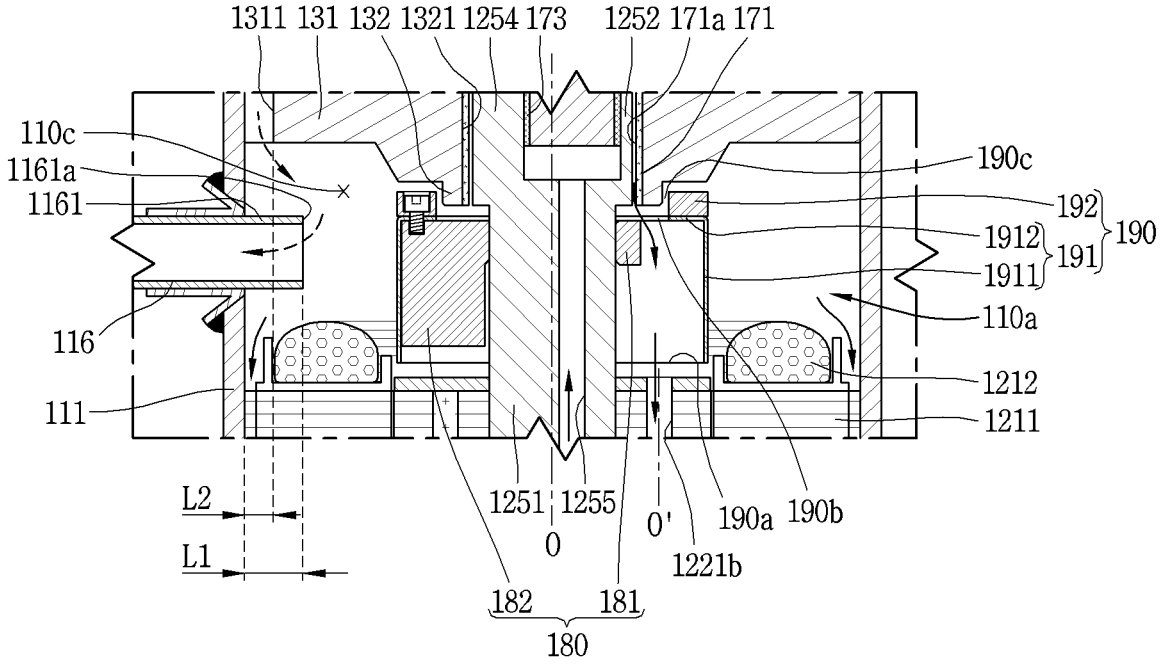
FIG. 3 is an enlarged cross-sectional view illustrating a part of a motor unit and a part of a compression unit in FIG. 2.

FIG. 2 is a cross-sectional view of a top-compression type scroll compressor in accordance with an implementation and FIG. 3 is an enlarged cross-sectional view illustrating a part of a motor unit and a part of a compression unit in FIG. 2.

Referring to FIGS. 2 and 3, a high-pressure type scroll compressor (hereinafter, described as a scroll compressor) according to the implementation may include a casing 110, a driving motor disposed in a lower half part of the casing 110, and a compression unit disposed above the driving motor 120. The compression unit may include a fixed scroll 140 and an orbiting scroll 150, and in some cases, may also include a main frame 130 disposed at an opposite side of the fixed scroll 140 with interposing the orbiting scroll 150 therebetween to support the orbiting scroll 150. Hereinafter, the compression unit may be defined as including the fixed scroll 140 and the orbiting scroll 150.

The casing 110 may include a cylindrical shell 111, an upper cap 112, and a lower cap 113. Accordingly, an inner space 110*a* of the casing 110 may be divided into an upper space 110*b* defined inside the upper cap 112, an intermediate space 110*c* defined inside the cylindrical shell 111, and a lower space 110*d* defined inside the lower cap 113, based on an order that refrigerant flows. Hereinafter, the upper space 110*b* may be defined as a discharge space, the intermediate space 110*c* may be defined as an oil separation space, and the lower space 110*d* may be defined as an oil storage space, respectively.

The cylindrical shell 111 may have a cylindrical shape with upper and lower ends open, and the driving motor 120 and the main frame 130 may be axially fitted on an inner circumferential surface of the cylindrical shell 111 at a lower half part and an upper half part, respectively.

A refrigerant discharge pipe 116 may be inserted through the intermediate space 110*c* of the cylindrical shell 111, in detail, coupled through a gap between the driving motor 120 and the main frame 130. The refrigerant discharge pipe 116 may be directly inserted into and welded to the cylindrical shell 111. Alternatively, an intermediate connecting pipe (i.e., collar pipe) 117 typically made of the same material as the cylindrical shell 111 may be inserted into and welded to the cylindrical shell 111 and then the refrigerant discharge pipe 116 made of copper may be inserted into and welded to the intermediate connection pipe 117.

The refrigerant discharge pipe 116 may have one end connected to the inner space 110*a* of the casing 110 and another end connected to an inlet of the condenser 20 constituting a refrigeration cycle apparatus. In other words, in this implementation, an oil return unit may not be disposed in the middle of the refrigerant discharge pipe 116 or, even if disposed, it may have a much smaller size than an oil return unit disclosed in Patent Document 1 described above. Therefore, hereinafter, it can be understood that the refrigerant discharge pipe 116 is directly connected to the condenser 20.

The refrigerant discharge pipe 116 may be inserted by a preset length into the inner space 110*a* of the casing 110. A portion of the refrigerant discharge pipe 116 that is inserted into the inner space 110*a* of the casing 110 may be defined as an inner accommodation portion 1161. The inner accommodation portion 1161 may be inserted to be located between the driving motor 120 and the main frame 130, more precisely, between a higher end than a stator coil 1212 of the driving motor 120 and a lower surface of the main frame 130. Accordingly, the refrigerant discharge pipe 116 can be deeply inserted into the inner space 110*a* of the casing 110 without interfering with the stator coil 1212. The refrigerant discharge pipe 116 including the shape of the inner accommodation portion 1161 will be described again later.

The upper cap 112 may be coupled to cover the open upper end of the cylindrical shell 111. A refrigerant suction pipe 115 may be coupled through the upper cap 112. The refrigerant suction pipe 115 may be inserted through the upper space 110*b* of the casing 110 to be directly connected to a suction chamber (no reference numeral given) of the compression unit to be described later. Accordingly, refrigerant can be supplied to the suction chamber through the refrigerant suction pipe 115.

The lower cap 113 may be coupled to cover the open lower end of the cylindrical shell 111. The lower space 110*d* of the lower cap 113 may define an oil storage space in which a preset amount of oil can be stored. The lower space 110*d* defining the oil storage space may communicate with the upper space 110*b* and the intermediate space 110*c* of the casing 110 through an oil return passage (no reference numeral given). Accordingly, oil separated from refrigerant in the upper space 110*b* and the intermediate space 110*c* and oil returned after being supplied to the compression unit can all be returned into the lower space 110*d* defining the oil storage space through oil return holes 1221*b* of a rotor 122 to be explained later.

Referring to FIGS. 2 and 3, the driving motor 120 according to this implementation may be disposed in a lower half part of the intermediate space 110*c* defining a high-pressure part at the inner space 110*a* of the casing 110, and include a stator 121 and a rotor 122. The stator 121 may be shrink-fitted to an inner wall surface of the cylindrical shell 111 and the rotor 122 may be rotatably disposed inside the stator 121.

The stator 121 may include a stator core 1211 and a stator coil 1212.

The stator core 1211 may be formed in a cylindrical shape and may be shrink-fitted to an inner circumferential surface of the cylindrical shell 111. The stator coil 1212 may be wound around the stator core 1211 and may be electrically connected to an external power source through a terminal (no reference numeral given) that is coupled through the casing 110.

The rotor 122 may include a rotor core 1221 and permanent magnets 1222.

The rotor core 1221 may be formed in a cylindrical shape, and may be rotatably inserted into the stator core 1211 with a preset gap therebetween. The permanent magnets 1222 may be embedded in the rotor core 1222 at preset intervals along a circumferential direction.

A shaft fixing hole 1221*a* into which the rotating shaft 125 is press-fitted may be formed through a center of the rotor core 1221 and at least one oil return hole 1221*b* may be formed along a circumference of the shaft fixing hole 1221*a*. For example, the oil return hole 1221*b* may be provided in plurality along the circumference of the shaft fixing hole 1221*a*. The plurality of oil return holes 1221*b* may have the same inner diameter. However, in some cases, the plurality of oil return holes 1221*b* may have different inner diameters. The oil return hole will be explained later along with an oil guide.

Referring to FIG. 2, the rotating shaft 125 may be press-fitted to the rotor 122. An upper end portion of the rotating shaft 125 may be rotatably inserted into the main frame 130 to be described later so as to be supported in a radial direction, and a lower end portion of the rotating shaft 125 may be rotatably inserted into a sub frame 118 to be supported in the radial and axial directions.

Specifically, the rotating shaft 125 may include a main shaft portion 1251, a main bearing portion 1252, a sub bearing portion 1253, and an eccentric portion 1254.

The main shaft portion 1251 may be a portion defining a middle part of the rotating shaft 125 and press-fitted into the shaft fixing hole 1221*a* formed in the rotor core 1221. A balance weight 180 to be described later may be press-fitted to an upper end of the main shaft portion 1251, that is, a portion extending from the main bearing portion 1252. The balance weight will be described later together with an oil guide.

The main bearing portion 1252 may be a portion defining an upper end of the rotating shaft 125 and rotatably inserted into a main bearing 171 disposed on the main frame 130 to be described later so as to be supported in the radial direction. The main bearing portion 1252 may have an outer diameter that is larger than that of the main shaft portion 1251. Accordingly, a portion of the main bearing portion 1252 that extends from the main shaft portion 1251 may be stepped.

The sub bearing portion 1253 may be a portion defining a lower end of the rotating shaft 125 and rotatably inserted into a sub bearing 172 disposed on the sub frame 118 so as to be supported in the radial direction. The sub bearing portion 1253 may have an outer diameter that is smaller than that of the main shaft portion 1251. Accordingly, a thrust bearing surface that is supported axially by the sub frame 118 may be stepped between the main shaft portion 1251 and the sub bearing portion 1253.

The eccentric portion 1254 may be a portion into which a rotating shaft coupling portion 152 of the orbiting scroll 150 to be described later is inserted, and may be formed inside the main bearing portion 1252. For example, the eccentric portion 1254 may be recessed by a preset depth into an upper end of the main bearing portion 1252 such that its center is eccentric with respect to a center (i.e., axial center) of the main bearing portion 1252. Accordingly, rotational force of the driving motor 120 can be transmitted to the orbiting scroll 150 through the eccentric portion 1254 such that the orbiting scroll 150 can perform an orbiting motion.

An eccentric portion bearing 173 may be disposed on an inner circumferential surface of the eccentric portion 1254. The eccentric portion bearing 173 may be configured as a bush bearing like the main bearing 171 and the sub bearing 172. Although not shown, the eccentric portion bearing 173 may alternatively be fitted to an outer circumferential surface of the rotating shaft coupling portion 152 of the orbiting scroll 150 to be described later.

In addition, an oil supply hole 1255 may be formed inside the rotating shaft 125 to penetrate between both ends of the rotating shaft 125. The oil supply hole 1255 may penetrate through from a lower end of the rotating shaft 125 to a bottom surface of the eccentric portion 1254. Accordingly, oil stored in the lower space 110*d* defining the oil storage space may be supplied into the eccentric portion 1254 through the oil supply hole 1255.

An oil pickup 126 may be installed at the lower end of the rotating shaft 125, precisely, at a lower end of the oil supply hole 1255. The oil pickup 126 may be disposed to be submerged in the oil stored in the oil storage space 110*d*. Accordingly, the oil stored in the oil storage space 110*d* can be pumped by the oil pickup 126 to be suctioned upward through the oil supply hole 1255.

Referring to FIGS. 2 and 3, the main frame 130 may be disposed above the driving motor 120 and may be shrink-fitted or welded to an inner wall surface of the cylindrical shell 111. Accordingly, the main frame 130 may typically be formed of cast iron.

The main frame 130 may include a main flange portion 131 and a shaft support protrusion 132.

The main flange portion 131 may be formed in an annular shape and accommodated in the intermediate space 110*a* of the cylindrical shell 111. For example, an outer circumferential surface of the main flange portion 131 may be formed in a circular shape to be in close contact with the inner circumferential surface of the cylindrical shell 111. In this case, at least one oil return hole (not shown) may axially penetrate through between outer and inner circumferential surfaces of the main flange portion 131.

In addition, at least one frame fixing protrusion (no reference numeral given) may radially extend from the outer circumferential surface of the main flange portion 131. An outer circumferential surface of the at least one frame fixing protrusion may be fixed in close contact with the inner circumferential surface of the cylindrical shell 111. In this case, the at least one frame fixing protrusion may include a second discharge passage groove 1311 that penetrates through between both side surfaces of the main flange portion in the axial direction. Accordingly, an upper end of the second discharge passage groove 1311 may communicate with a first discharge passage groove 1421 of the fixed scroll 140 to be described later, and a lower end of the second discharge passage groove 1311 may communicate with the intermediate space 110*c* that communicates with the refrigerant discharge pipe 116.

The shaft support protrusion 132 may extend from the center of the main flange portion 131 toward the driving motor 120. Here, an outer diameter of the shaft support protrusion 132 may be smaller than an inner diameter of the oil block 192 to be described later. Accordingly, the shaft support protrusion 132 may be accommodated at a preset interval in an oil block 192 to be described later that surrounds the shaft support protrusion 132.

A shaft support hole 1321 may be formed inside the shaft support protrusion 132. The shaft support hole 1321 may be formed through both axial side surfaces of the main flange portion 131. Accordingly, the main flange portion 131 may have an annular shape.

The shaft support hole 1321 may have the same inner diameter at both ends in the axial direction, and the main bearing 171 may be fixedly inserted into the shaft support hole 1321. The main bearing 171 may be configured as a bush bearing. Accordingly, an inner circumferential surface of the shaft support hole 1321, precisely, an inner circumferential surface of the main bearing 171 may define a main bearing surface 171*a* together with an outer circumferential surface of the main bearing portion 1252 of the rotating shaft 125. The main bearing surface will be described later together with an oil guide.

Still referring to FIGS. 2 to 3, the fixed scroll 140 may include a fixed end plate 141, a fixed side wall portion 142, and a fixed wrap 143.

The fixed end plate 141 may be formed in a disk shape. An outer circumferential surface of the fixed end plate 141 may be in close contact with an inner circumferential surface of the upper cap 112 defining the upper space 110*b* or may be spaced apart from the inner circumferential surface of the upper cap 112.

A suction port 1411 may be formed through an edge of the fixed end plate 141 in the axial direction to communicate with a suction chamber (no reference numeral given). The refrigerant suction pipe 115 may be inserted into the suction port 1411 through the upper cap 112 of the casing 110. Accordingly, the refrigerant suction pipe 115 can directly communicate with the suction port 1411 of the fixed scroll 140 through the upper space 110*b* of the casing 110.

A discharge port 1412 and a bypass hole may be formed through a center of the fixed end plate 141. A discharge valve 145 for opening and closing the discharge port 1412 and a bypass valve for opening and closing the bypass hole may be disposed on an upper surface of the fixed end plate 141. Accordingly, refrigerant compressed in a compression chamber V may be discharged from an upper side of the fixed scroll 140 into the upper space 110*b* defined in the upper cap 112.

The fixed side wall portion 142 may extend in an annular shape from an edge of the fixed end plate 141 toward the main frame 130. Accordingly, a lower surface of the fixed side wall portion 142 may be coupled by bolts in close contact with an upper surface of the main frame 130, that is, an upper surface of the main flange portion 131.

At least one first discharge passage groove 1421 may be formed at an outer circumferential surface of the fixed side wall portion 142. The first discharge passage groove 1421 may be recessed into an outer circumferential surface of the fixed scroll 140 such that both axial side surfaces of the fixed scroll 140 communicate with each other. For example, an upper surface of the fixed end plate 141 and a lower surface of the fixed side wall portion 142 may communicate with each other through the first discharge passage groove 1421. Accordingly, an upper end of the first discharge passage groove 1421 can communicate with the upper space 110*b* and a lower end of the first discharge passage groove 1421 can communicate with an upper end of the second discharge passage groove 1311 formed at the main frame 130.

The fixed wrap 143 may extend from a lower surface of the fixed end plate 141 toward the orbiting scroll 150. The fixed wrap 143 may be formed in various shapes, such as an involute shape. The fixed wrap 143 may be engaged with an orbiting wrap 153 to be described later to define a pair of compression chambers V.

Still referring to FIGS. 2 and 3, the orbiting scroll 150 may include an orbiting end plate 151, a rotating shaft coupling portion 152, and an orbiting wrap 153.

The orbiting end plate 151 may be formed in a disk shape and supported axially by the main frame 130 so as to perform an orbiting motion between the main frame 130 and the fixed scroll 140.

The rotating shaft coupling portion 152 may extend from a geometric center of the orbiting scroll 150 toward the eccentric portion 1254 of the rotating shaft 125. The rotating shaft coupling portion 152 may be rotatably inserted into the eccentric portion 1254 of the rotating shaft 125. Accordingly, the orbiting scroll 150 can perform the orbiting motion by the eccentric portion 1254 of the rotating shaft 125 and the rotating shaft coupling portion 152.

The orbiting wrap 153 may extend from an upper surface of the orbiting end plate 151 toward the fixed scroll 140. The orbiting wrap 153 may be formed in various shapes such as an involute shape to correspond to the fixed wrap 143.

In the drawings, an unexplained reference numeral 1161*a* denotes an inner end of the refrigerant discharge pipe.

The scroll compressor according to the implementation can obtain the following operating effects.

That is, when power is applied to the driving motor 120 to generate a rotational force, the orbiting scroll 150 eccentrically coupled to the rotating shaft 125 performs an orbiting motion. During the orbiting motion, a pair of compression chambers V which continuously move are formed between the orbiting scroll 150 and the fixed scroll 140.

Then, the compression chambers V may gradually become smaller in volume as they move from the suction port 1411 (or suction chamber) to the discharge port 1412 (or discharge chamber) while the orbiting scroll 150 is performing the orbiting motion.

Refrigerant supplied from outside of the casing 110 then flows through the suction port 1411 of the fixed scroll 140 via the refrigerant suction pipe 115. This refrigerant is compressed while moving toward a final compression chamber by the orbiting scroll 150. The refrigerant is discharged from the final compression chamber into the inner space 110*a* (upper space) of the casing 110 through the discharge port 1412 of the fixed scroll 140, and then moves to the intermediate space 110*c* of the cylindrical shell 111 or the lower space 110*d* of the lower cap 113 through a refrigerant guide passage defined by the first discharge passage groove 1421 and the second discharge passage groove 1311.

Oil is separated from the refrigerant while the refrigerant circulates in the inner space 110*a* of the casing 110. The oil separated from the refrigerant may flow to be filled in the oil storage space defining the lower space 110*d* of the casing 110 and then supplied to the compression unit through the oil pickup 126 and the oil supply hole 1255 of the rotating shaft 125. On the other hand, the refrigerant from which the oil has been separated is discharged to the outside of the casing 110 through the refrigerant discharge pipe 116. Such processes are repeated.

Meanwhile, in the scroll compressor according to the implementation, an oil guide 190 may be installed between the driving motor 120 and the main frame 130. This structure can prevent oil mixed with refrigerant from flowing out of the casing 110 through the refrigerant discharge pipe 116 while the oil is returned to the lower space 110*c* defining the oil storage space through the main bearing surface 171*a* after lubricating the compression unit.

Figure 4:
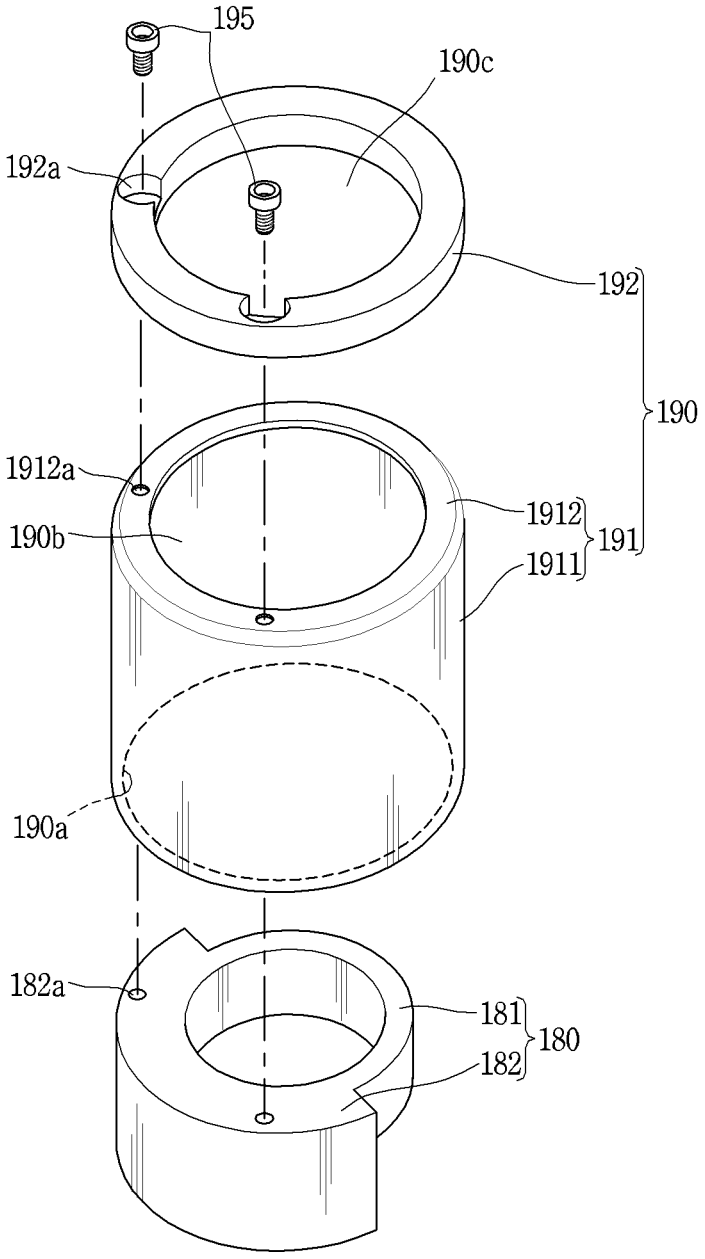
FIG. 4 is an exploded perspective view illustrating an oil guide according to the implementation.
Figure 5:
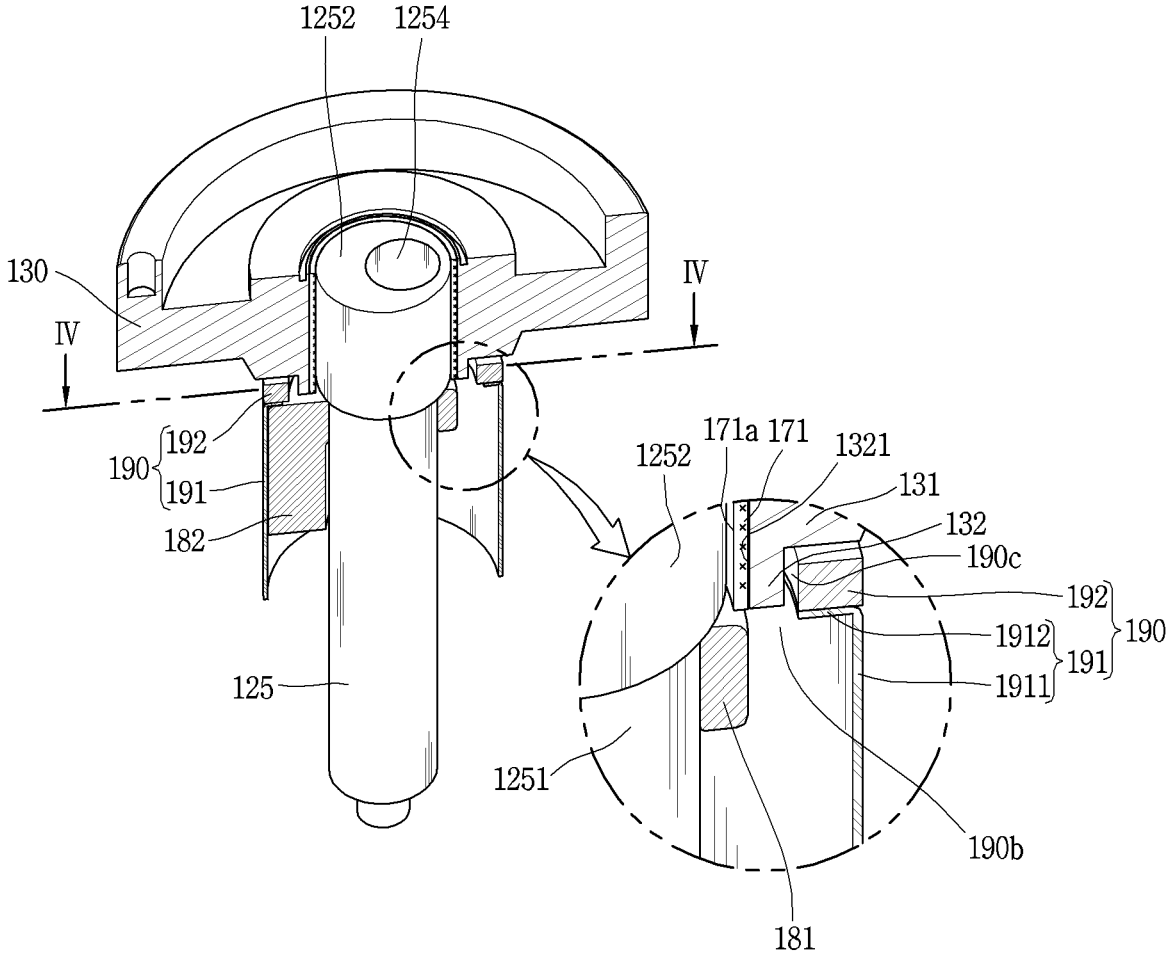
FIG. 5 is a cutout perspective view illustrating a state in which the oil guide of FIG. 4 is assembled with a rotating shaft.
Figure 6:
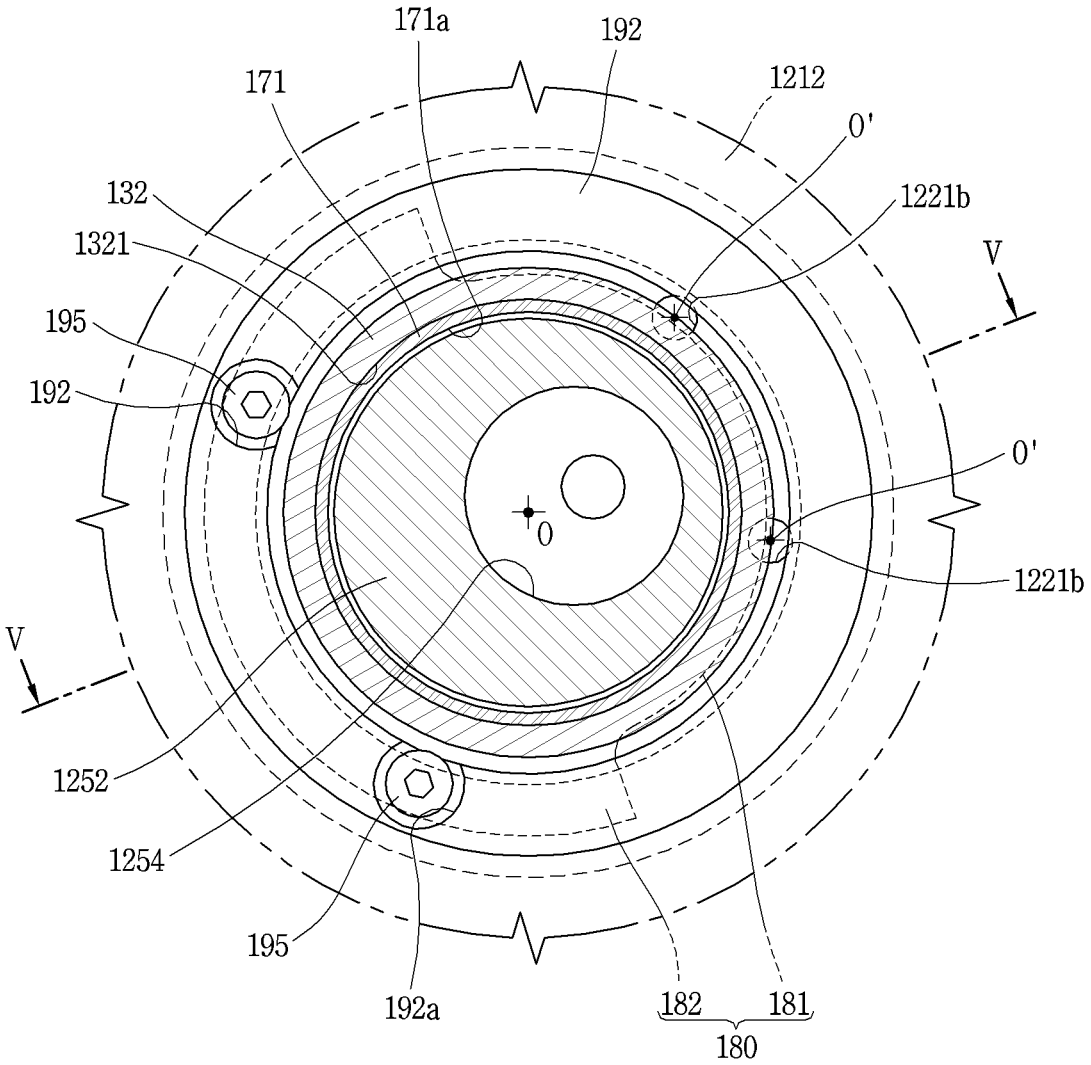
FIG. 6 is a cross-sectional view taken along the line "IV-IV" of FIG. 5.
Figure 7:
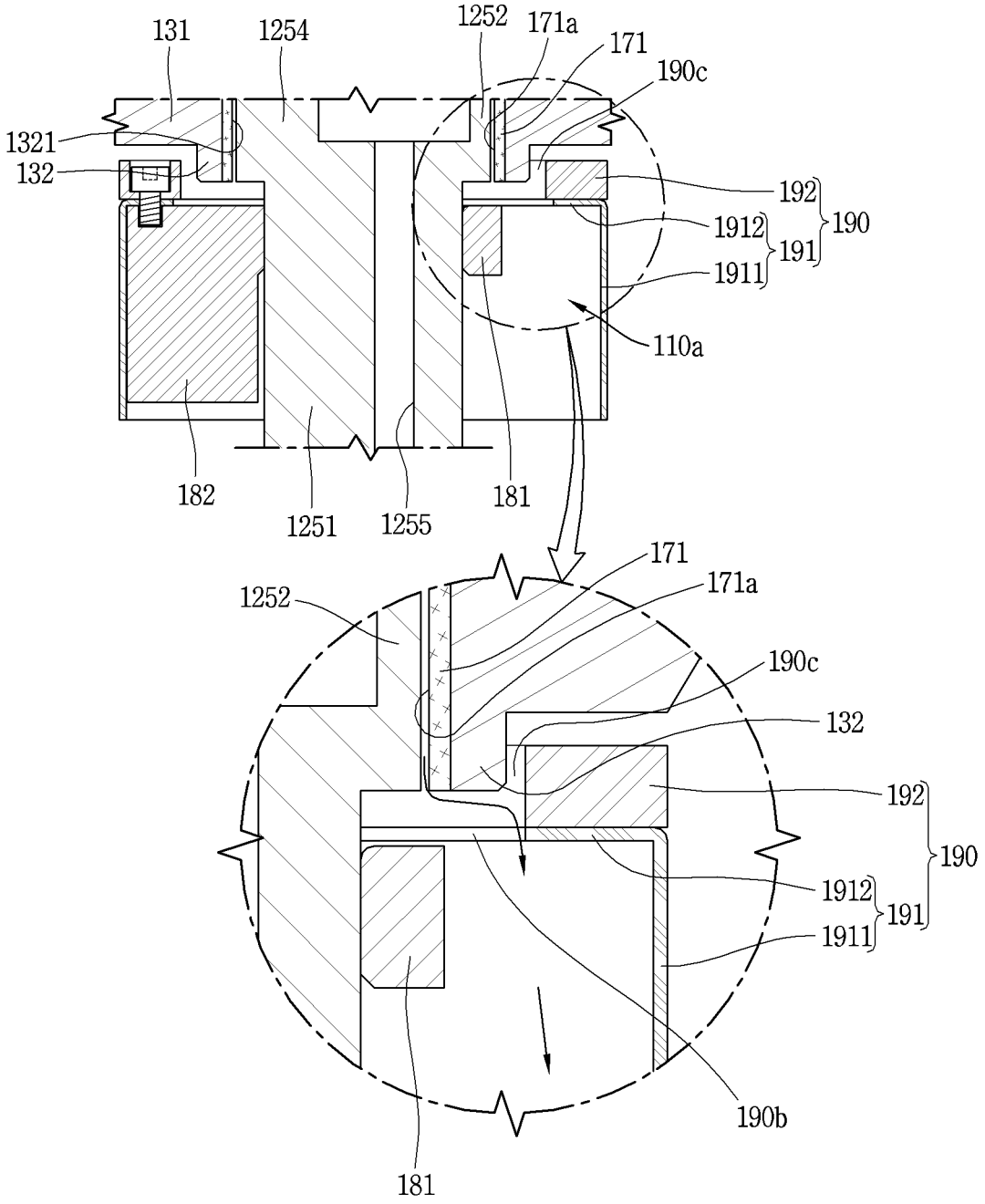
FIG. 7 is a cross-sectional view taken along the line "V-V" of FIG. 6.

FIG. 4 is an exploded perspective view illustrating the oil guide according to the implementation, FIG. 5 is a cutout perspective view illustrating a state in which the oil guide of FIG. 4 is assembled with the rotating shaft, FIG. 6 is a cross-sectional view taken along the line "IV-IV" of FIG. 5, and FIG. 7 is a cross-sectional view taken along the line "V-V" of FIG. 6.

Referring to FIGS. 4 to 7, the oil guide 190 may include an oil cap 191 and an oil block 192. The oil cap 191 may extend toward the rotor 122 based on the balance weight 180, and the oil block 192 may extend toward the main frame 130 based on the balance weight 180.

For example, the balance weight 180 may include a fixed mass portion 181 fixed to the rotating shaft 125, and an eccentric mass portion 182 eccentrically extending from the fixed mass portion 181.

The fixed mass portion 181 may be formed in an annular shape and fixed to the main shaft portion 1251 of the rotating shaft 125 at an upper side of the rotor 122, and the eccentric mass portion 182 may eccentrically extend from one side of an outer circumferential surface of the fixed mass portion 181 to have a fan-like arcuate shape. Accordingly, an outer diameter of the fixed mass portion 181 may be larger than an outer diameter of the rotating shaft 125 (main shaft portion) and smaller than an outer diameter of the eccentric mass portion 182.

However, since the oil cap 191, which will be described later, is coupled to the eccentric mass portion 182 and inserted into the stator coil 1212, the outer diameter of the eccentric mass portion 182 may be smaller than a diameter of a virtual circle connecting the inner circumferential surface of the stator coil 1212, for example, an inner diameter of the stator core 1211.

Referring to FIGS. 4 and 5, the oil cap 191 may include an oil guide portion 1911 and a cap fixing portion 1912.

The oil guide portion 1911 may be formed in a cylindrical shape with both ends open. An upper end of the oil guide portion 1911 may be fixedly coupled to the balance weight 180 using the cap fixing portion 1912 to be described later, and a lower end of the oil guide portion 1911 may extend toward an upper end of the rotor 122. In other words, the oil guide portion 1911 may have a length that is longer than a distance from an upper surface of the balance weight 180 to an upper end of the stator coil 1212. Accordingly, the lower end of the oil guide portion 1911 defining a lower opening 190*a* of the oil guide 190 may be inserted into the stator coil 1212.

An inner diameter of the oil guide portion 1911 may be larger than or equal to an outer diameter of the balance weight 180, that is, an outer diameter of the eccentric mass portion 182. Accordingly, the balance weight 180 can be accommodated in the oil guide portion 1911.

In addition, the inner diameter of the oil guide portion 1911 may be larger than or equal to a diameter of a virtual circle having a radius from an axial center O of the rotating shaft 125 to a center O' of the oil return hole 1221*b*. For example, the inner diameter of the oil guide portion 1911 may have size that can accommodate all of the oil return holes 1221*b* inside the oil guide portion 1911. Accordingly, oil returned along the oil guide portion 1911 can move into the oil return holes 1221*b* to be returned into the oil storage space 110*d* through the oil return holes 1221*b*. This can make oil returned through the main bearing surface 171*a* quickly returned to the oil storage space 110*d*, thereby minimizing an oil leakage.

The cap fixing portion 1912 may be formed in an annular shape by being bent inwardly from the upper end of the oil guide portion 1911 toward the upper surface of the balance weight 180. For example, an inner diameter of the cap fixing portion 1912 may be smaller than the outer diameter of the eccentric mass portion 182. Accordingly, the cap fixing portion 1912 can be supported in the axial direction by being placed on the upper surface of the eccentric mass portion 182 defining the upper end of the balance weight 180.

The cap fixing portion 1912 may be coupled to the upper surface of the eccentric mass portion 182. For example, coupling grooves 182*a* may be formed at the upper surface of the eccentric mass portion 182 and through holes 1912*a* may be formed through the cap fixing portion 1912 to correspond to the coupling grooves 182*a* of the eccentric mass portion 182 on the same axis. Accordingly, the cap fixing portion 1912 can be coupled to the eccentric mass portion 182 by bolts.

Here, the oil block 192 to be described later may be formed independent of the oil guide portion 1911 or the cap fixing portion 1912 of the oil cap 191 and fixed to the balance weight 180. In this case, coupling holes 192*a* may be formed through the oil block 192. The coupling holes 192*a* may be formed to correspond to the through holes 1912*a* of the cap fixing portion 1912 and the coupling grooves 182*a* of the eccentric mass portion 182 on the same axis. With the configuration, the oil guide 190 and the oil block 192 can be coupled to the balance weight 180 by the same coupling bolts 195, which can facilitate assembling of the oil guide 190 including the oil block 192.

The inner diameter of the cap fixing portion 1912 may be smaller than the outer diameter of the eccentric mass portion 182 and larger than the outer diameter of the fixed mass portion 181 of the balance weight 180. In other words, an outer circumferential surface of the fixed mass portion 181 and an inner circumferential surface of the cap fixing portion 1912 may be spaced apart from each other by a preset distance. Accordingly, an intermediate opening 190*b* of the oil guide 190 which is defined by the inner circumferential surface of the cap fixing portion 1912 may always be open in a section out of the eccentric mass portion 182, namely, a section where the fixed mass portion 181 is formed in the circumferential direction even if the intermediate opening 190*b* is partially blocked by the eccentric mass portion 182 of the balance weight 180. Then, the oil guide portion 1911 can be maintained in a partially open state without being completely blocked by the balance weight 180, such that oil returned through the main bearing surface 171*a* can be smoothly guided to the oil return holes 1221*b*.

The inner diameter of the cap fixing portion 1912 may be as large as possible, which can be advantageous in terms of return of oil scattered from the main bearing surface 171*a*. However, if the inner diameter of the cap fixing portion 1912 is excessively large while the outer diameter of the cap fixing portion 1912 (exactly, the outer diameter of the oil guide portion) is set, a width of the cap fixing portion 1912 may be excessively reduced. This may make it difficult to stably fix the oil block 192 extending from the cap fixing portion 1912. Accordingly, the inner diameter of the cap fixing portion 1912 may be set to be as large as possible so as to secure an area of the intermediate opening 190*b* of the oil guide 190, but may preferably be large enough to stably fix the oil block 192. For example, the inner diameter of the cap fixing portion 1912 may be approximately half a width of the eccentric mass portion 182 excluding the fixed mass portion 181.

On the other hand, the oil block 192 may be disposed on an upper end of the oil cap 191. In other words, the oil block 192 may be a portion defining an upper end part of the oil guide 190, and may extend from the upper end of the oil cap 191 toward the main frame 130 in the axial direction.

Referring to FIGS. 4 and 7, the oil block 192 may be formed in an annular shape to surround the main bearing surface 171*a*, and an upper end of the oil block 192 may be higher than or at least equal to a lower end of the main bearing surface 171*a*. In other words, at least part of the oil block 192 may radially overlap the shaft support protrusion 132 defining the main bearing surface 171*a*, so as to surround the main bearing surface 171*a*. Accordingly, even if the upper end of the oil guide 190, that is, the upper end of the oil block 192 is open, oil returned through the main bearing surface 171*a* can be prevented from flowing toward the refrigerant discharge pipe 116 through an upper opening 190*c* of the oil guide 190.

Specifically, the oil block 192 may extend axially from the cap fixing portion 1912. Here, an inner diameter of the oil block 192 may be larger than an inner diameter of the main bearing surface 171*a* and larger than or equal to the inner diameter of the cap fixing portion 1912. Accordingly, oil returned through the main bearing surface 171*a* can be collected inside the oil cap 191 and smoothly guided to the oil return holes 1221*b* of the rotor 122.

In addition, the oil block 192 may be separately manufactured to be post-assembled with the oil guide portion 1911 or the cap fixing portion 1912. For example, the oil block 192 may be formed in an annular shape and placed on the upper surface of the cap fixing portion 1912. In this state, the oil block 192 may be coupled to the eccentric mass portion 182 of the balance weight 180 together with the cap fixing portion 1912. In this case, since the coupling holes 192*a* of the oil block 192, as aforementioned, are formed on the same axis with the through holes 1912*a* of the cap fixing portion 1912 and the coupling grooves 182*a* of the eccentric mass portion 182, the oil block 192 can be coupled to the eccentric mass portion 182 together with the cap fixing portion 1912 by the same coupling bolts 195.

Also, the oil block 192 may have an even inner circumferential surface. For example, the inner circumferential surface of the oil block 192 may have a single (uniform) inner diameter between both ends in the axial direction. This can facilitate manufacturing of the oil block 192. In addition, the oil block 192 can be easily assembled while maintaining a close distance between the inner circumferential surface of the oil block 192 and an outer circumferential surface of the shaft support hole 1321. This can suppress oil from flowing out of the oil guide 190.

The oil block 192 may be configured such that a first distance t1 between the inner circumferential surface of the oil block 192 and the outer circumferential surface of the shaft support protrusion 132 that faces the oil block 192 is smaller than a second distance t2 between the inner circumferential surface of the oil block 192 and the outer circumferential surface of the fixed mass portion 181 that faces the oil block 192. Accordingly, oil that is scattered from the lower end of the main bearing surface 171*a* can be blocked so as to be effectively suppressed from flowing out of the oil guide 190. This can reduce an oil leakage loss in the compressor.

As described above, when the oil block 192 is disposed on the upper end of the oil guide 190 to overlap the shaft support protrusion 132, oil returned to the oil storage space through the main bearing surface 171*a* can be suppressed from flowing to the outside of the oil guide 190, thereby remarkably reducing an oil leakage in the compressor.

In particular, when the inner accommodation portion 1161 of the refrigerant discharge pipe 116 accommodated in the inner space 110*a* of the casing 110 is deeply inserted to be close to the main bearing surface 171*a*, oil returned through the main bearing surface 171*a* partially flows over the oil guide 190 and is suctioned toward the refrigerant discharge pipe 116, thereby increasing an oil leakage loss in the compressor.

However, when the oil block 192 is disposed on the upper end of the oil guide 190 to overlap the main bearing surface 171*a* in the radial direction, the oil guide 190 surrounding the main bearing surface 171*a* may form a kind of oil barrier. Thus, the oil leakage to the refrigerant discharge pipe 116 by flowing over the oil guide 190 can be minimized. In this way, a friction loss due to insufficient oil in the compressor can be reduced.

Hereinafter, another implementation of an oil block will be described.

That is, the previous implementation illustrates that the inner circumferential surface of the oil block 192 has the single or uniform inner diameter, but in some cases, the inner circumferential surface of the oil block 192 may have a plurality of inner diameters.

Figure 8:
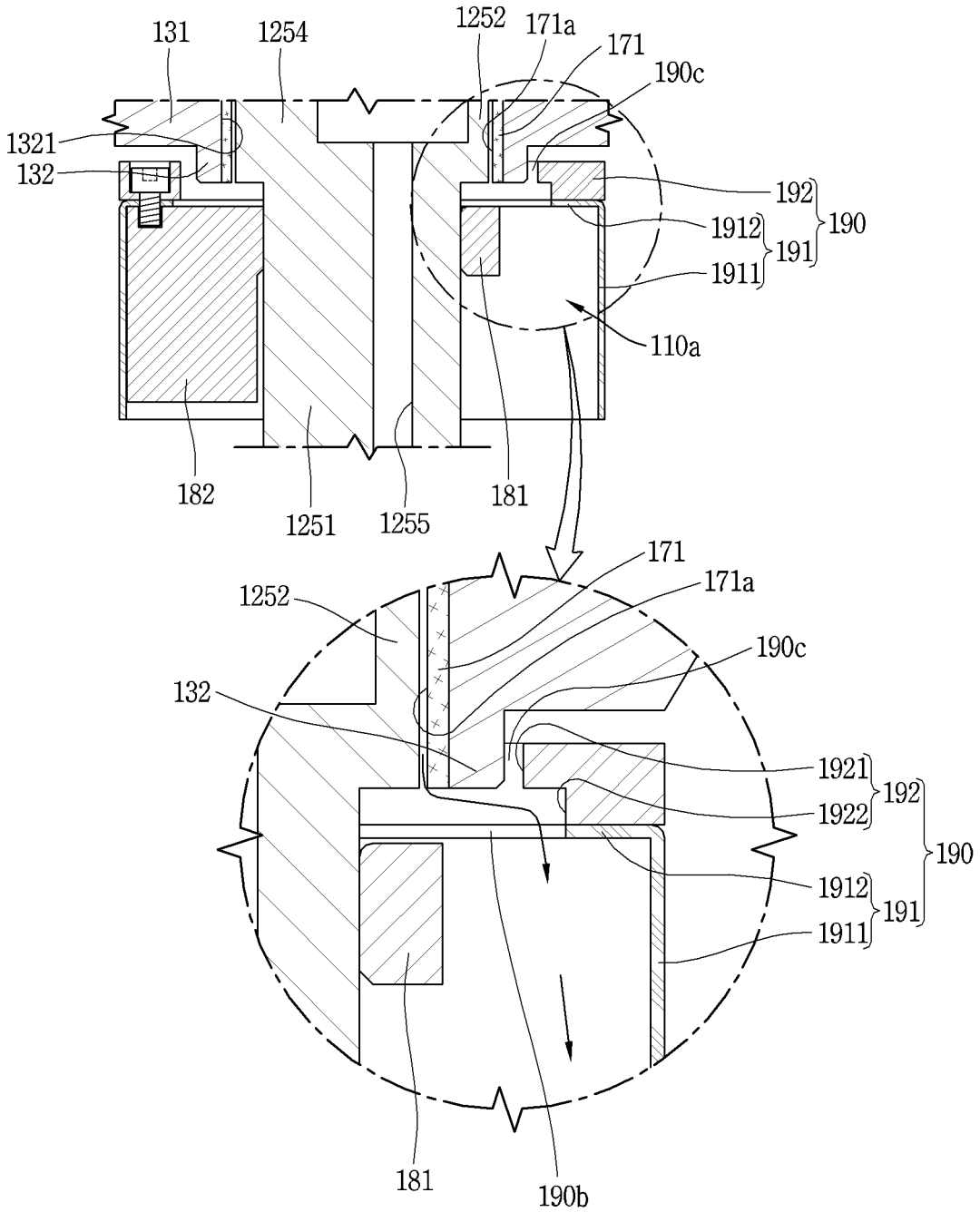
FIG. 8 is a cross-sectional view taken along the line "V-V" for explaining another example of an oil guide.

FIG. 8 is a cross-sectional view taken along the line "V-V" for explaining another example of an oil guide.

Referring to FIG. 8, the oil block 192 according to this implementation may include an oil sealing portion 1921 and an oil return portion 1922. The oil sealing portion 1921 may be formed at an upper half part of the inner circumferential surface of the oil block 192 and the oil return portion 1922 may be formed at a lower half part of the inner circumferential surface of the oil block 192 in succession with the oil sealing portion 1921.

The oil sealing portion 1921 may be formed in an annular shape along the inner circumferential surface of the oil block 192. The oil sealing portion 1921 may have the same radius based on an axial center O so that a distance from the outer diameter of the shaft support protrusion 132 is constant.

The oil return portion 1922 may also be formed in an annular shape along the inner circumferential surface of the oil block 192. However, since the oil block 192 is mounted on the upper surface of the eccentric mass portion 182 of the balance weight 180, the oil return portion 1922 may not need to be formed on a portion overlapping the eccentric mass portion 182. Accordingly, the oil return portion 1922 may be formed in an arcuate shape, that is, formed on a portion excluding the eccentric mass portion 182 along the circumferential direction.

The oil return portion 1922 may be recessed into a lower edge of the oil block 192 by a preset depth in the radial direction. For example, the oil return portion 1922 may be stepped on the inner circumferential surface of the oil block 192. Accordingly, the oil sealing portion 1921 may have a first inner diameter and the oil return portion 1922 may have a second inner diameter larger than the first inner diameter.

The oil return portion 1922 may be higher than or equal to the lower end (outlet-side end) of the shaft support protrusion 132. With the configuration, oil scattered from the lower end (outlet-side end) of the shaft support protrusion 132 can be suppressed from colliding with the oil sealing portion 1921. This can minimize the oil from flowing toward the upper opening 190*c* along the oil sealing portion 1921, thereby further reducing a friction loss due to an oil shortage in the compressor.

In some implementations, the oil return portion 1922 may be inclined so that its inner diameter is increased toward the lower edge. Even in this case, an operating effect of the oil return portion may be similar to that of the previous implementation.

Hereinafter, another implementation of an oil guide will be described.

That is, the previous implementations illustrate that the oil block 192 is separately manufactured from the oil cap 191 so as to be post-assembled with the balance weight 180, but in some cases, the oil cap 191 and the oil block 192 may be integrally formed with each other.

Figure 9:
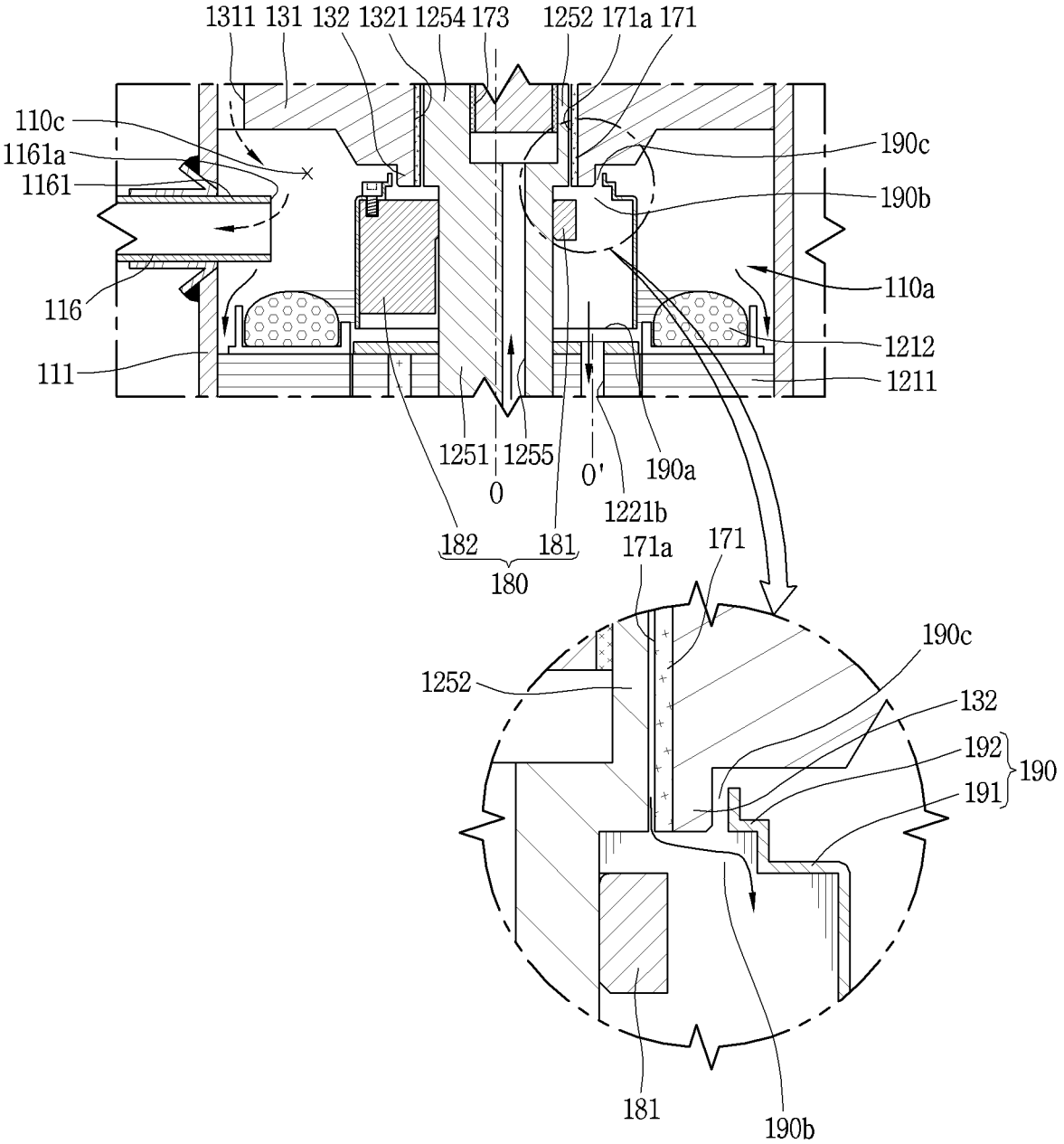
FIG. 9 is a cross-sectional view illustrating still another example of an oil guide.

FIG. 9 is a cross-sectional view illustrating still another implementation of an oil guide.

Referring to FIG. 9, the oil guide 190 may include the oil cap 191 and the oil block 192 that are integrally formed with each other.

For example, the oil guide portion 1911 defining the oil cap 191 may be formed in a cylindrical shape and the cap fixing portion 1912 may be formed in an annular shape by being radially bent from an inner circumferential surface of an upper end of the oil guide portion 1911.

The oil block 192 may be formed in the annular shape by being bent axially from an inner circumference of the cap fixing portion 1912. Accordingly, the oil guide 190 can be configured as a module type in which the oil cap 191 including the oil guide portion 1911 and the cap fixing portion 1912 and the oil block 192 are integrated into a single component.

As described above, the oil guide 190 in which the oil cap 191 and the oil block 192 are integrated into the single component can provide the same basic configuration and operating effects as those of the previous implementations in which the oil block 192 and the oil cap 191 are post-assembled with each other, so a detailed description thereof will be replaced with the description in the previous implementations.

However, in this implementation, the oil block 192 can be integrally formed with the oil cap 191, which can facilitate manufacturing of the overall oil guide 190.

Also, the oil block 192 according to this implementation may have the same thickness as the oil cap 191. That is, in the previous implementations, the oil block 192 needs a radial thickness sufficient for bolts to be coupled in consideration of a coupling width. However, in this implementation, the oil block 192 may not need to be separately coupled and thus the thickness of the oil block 192 can be reduced. Therefore, the thickness of the oil block 192 can be thinner than that in the previous implementations, thereby reducing weight and cross-sectional area of the oil guide 190 and improving motor efficiency.

Hereinafter, still another implementation of an oil guide will be described.

That is, the previous implementations illustrate that the oil guide is assembled with the balance weight coupled to the rotating shaft, but in some cases, the oil guide may alternatively be coupled to a fixing member together with the stator or main frame.

Figure 10:
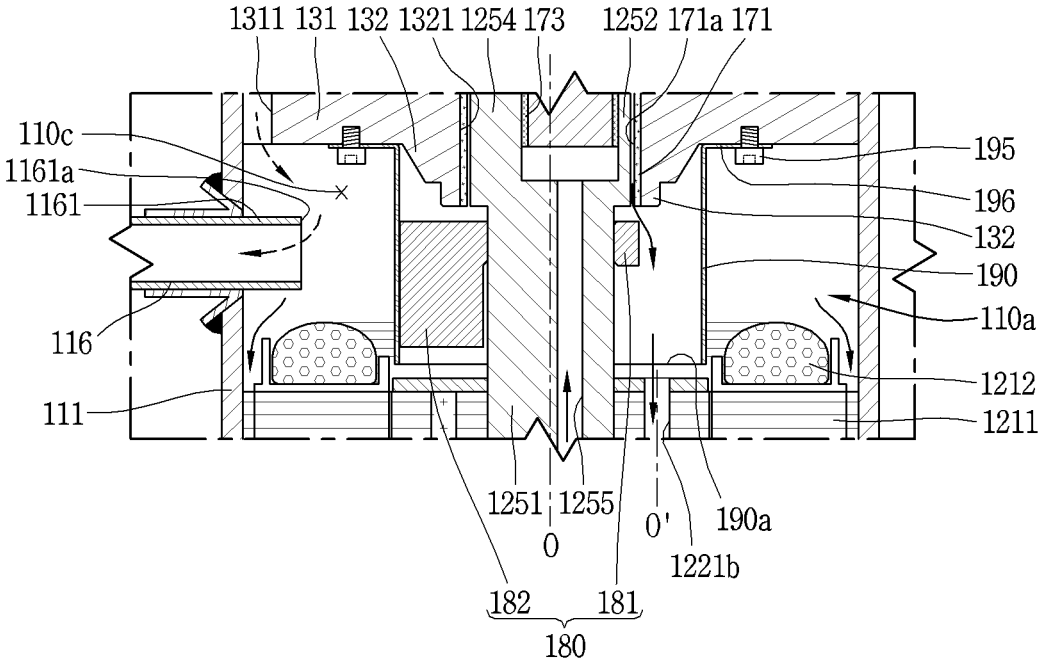
FIG. 10 is a cross-sectional view illustrating still another example of an oil guide.

FIG. 10 is a cross-sectional view illustrating still another implementation of an oil guide.

Referring to FIG. 10, the upper end of the oil guide 190 according to this implementation may be fixedly coupled to the lower surface of the main frame 130.

For example, the oil guide 190 may be formed in a cylindrical shape. A guide fixing portion 196 may be bent from an upper end of the oil guide 190 to extend in a flange shape. The guide fixing portion 196 may be coupled to the lower surface of the main frame 130 by bolts.

In this case, the guide fixing portion 196 of the oil guide 190 may have a flat upper surface to be fixed in close contact with the lower surface of the main frame 130. The guide fixing portion 196 of the oil guide 190 may be fixed to be located between the second refrigerant guide groove 1311 and the main bearing surface 171*a*, that is, between an inner end 1161*a* of the refrigerant discharge pipe 116 and the main bearing surface 171*a*. Accordingly, the inner end 1161*a* of the refrigerant discharge pipe 116 and the main bearing surface 171*a* can be completely blocked from each other, such that oil returned through the main bearing surface 171*a* can be almost completely prevented from flowing directly into the refrigerant discharge pipe 116.

In addition, as the oil guide 190 is fixedly coupled to the main frame 130, an overall weight of a rotating body including the rotor 122 can be reduced, thereby improving motor efficiency.

On the other hand, as described above, in the high-pressure type scroll compressor, refrigerant and oil are separated in the inner space 110*a* of the casing 110, so that the oil is stored and the refrigerant is discharged to the outside of the compressor, namely, the casing 110 through the refrigerant discharge pipe 116. However, since the refrigerant discharge pipe 116 communicates with the intermediate space 110*c* located between the driving motor 120 and the compression unit, that is, between the upper space 110*b* (discharge space) and the lower space 110*d* (oil storage space), oil discharged into the upper space 110*d* together with the refrigerant may not be sufficiently separated from the refrigerant but flow to the refrigerant discharge pipe 116 in the intermediate space 110*c*. This may cause an oil leakage loss in the compressor, thereby increasing a friction loss in the compression unit.

In consideration of this, a separate oil separation member may be installed near the refrigerant discharge pipe 116, which may, however, increase the number of parts and manufacturing costs. Accordingly, in this implementation, the refrigerant discharge pipe 116 may be formed in an appropriate shape to enhance an oil separation effect even without installing a separate oil separation member near the refrigerant discharge pipe 116.

Referring back to FIGS. 2 and 3, the refrigerant discharge pipe 116 may be deeply inserted into the inner space 110*a* of the casing 110 by a preset depth. For example, the inner end 1161*a* of the refrigerant discharge pipe 116 accommodated in the inner space 110*a* of the casing 110, that is, the end of the inner accommodation portion 1161 may be inserted to be closer to the rotating shaft 125 than a lower end of the second refrigerant guide groove 1311 defining an outlet-side end of a refrigerant guide passage.

Specifically, an insertion depth L1 of the refrigerant discharge pipe 116, which is defined as a length from the inner circumferential surface of the casing 110 to the inner end 1161*a* of the refrigerant discharge pipe 116, may be longer than a radial length L2 from the inner circumferential surface of the casing 110 to the lower end of the second refrigerant guide groove 1311 formed at the main frame 130.

For example, the refrigerant discharge pipe 116, as described above, may be inserted between the upper end of the stator coil 1212 and the lower surface of the main frame 130, that is, up to a position where the inner accommodation portion 1161 of the refrigerant discharge pipe 116 axially overlaps the stator coil 1212. Accordingly, the inner end 1161*a* of the refrigerant discharge pipe 116 may be located radially away from the lower end of the second refrigerant guide groove 1311.

In some implementations, the end of the inner accommodation portion 1161 may be inserted to be located at the same distance as the lower end of the second refrigerant guide groove 1311, which defines outlet-side end of the refrigerant guide passage, from the rotating shaft 125.

As described above, when the inner end 1161*a* of the refrigerant discharge pipe 116 is deeply inserted into the inner space 110*a* of the casing 110, a distance from the lower end of the second refrigerant guide groove 1311 defining the outlet-side end of the refrigerant guide passage to the inner end 1161*a* of the refrigerant discharge pipe 116 may be increased. In other words, the second refrigerant guide groove 1311 may be formed adjacent to the inner circumferential surface of the casing 110, whereas the inner end 1161*a* defining an inlet of the refrigerant discharge pipe 116 may be located far from the inner circumferential surface of the casing 110.

Then, refrigerant that passes through the second refrigerant guide groove 1311 to move to the intermediate space 110*c* where the refrigerant discharge pipe 116 is located should radially move by a long distance toward the inner end 1161*a* of the refrigerant discharge pipe 116.

This can increase a flowing time or flowing path of the refrigerant in the inner space 110*a* of the casing 110, thereby improving the oil separation effect of separating oil from the refrigerant. In this way, a friction loss due to insufficient oil in the compressor can be reduced.

Hereinafter, another implementation of a refrigerant discharge pipe will be described.

That is, the previous implementation illustrates that the refrigerant discharge pipe is configured as a hollow pipe having a single discharge passage, but in some cases, the refrigerant discharge pipe may alternatively be formed in a shape having a plurality of discharge passages.

Figure 11:
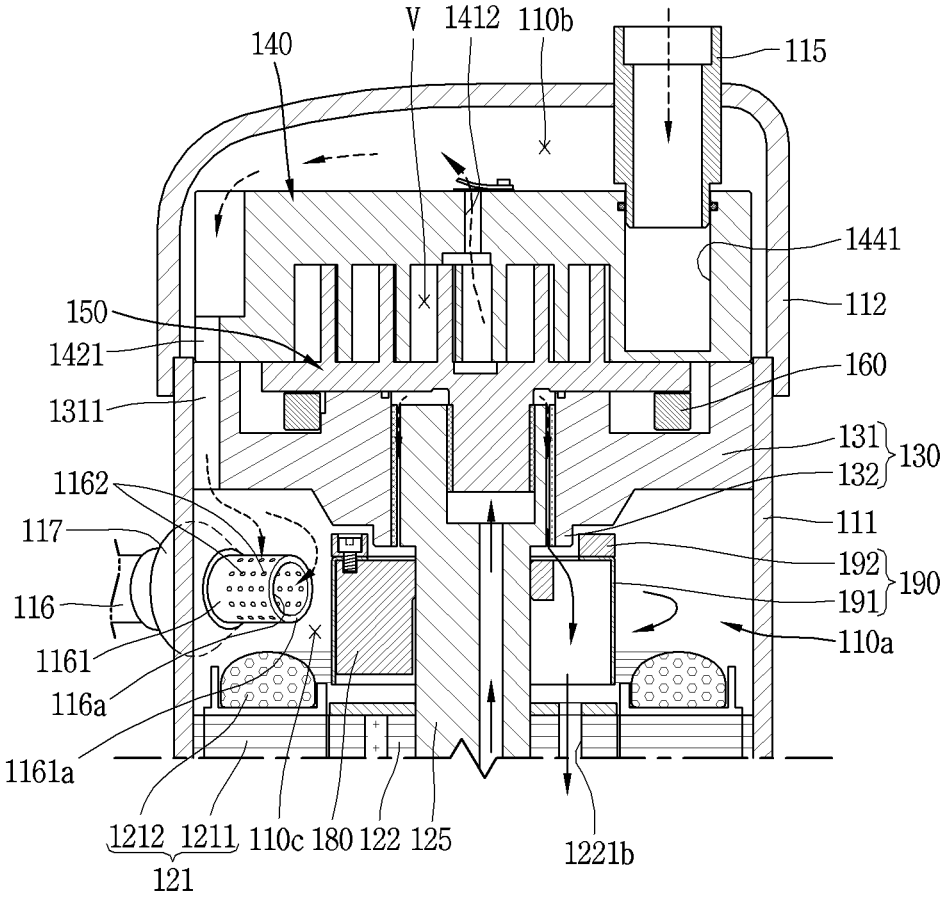
FIG. 11 is a cross-sectional view illustrating a part of the scroll compressor of FIG. 2 to which another example of a refrigerant discharge pipe is applied.
Figure 12:
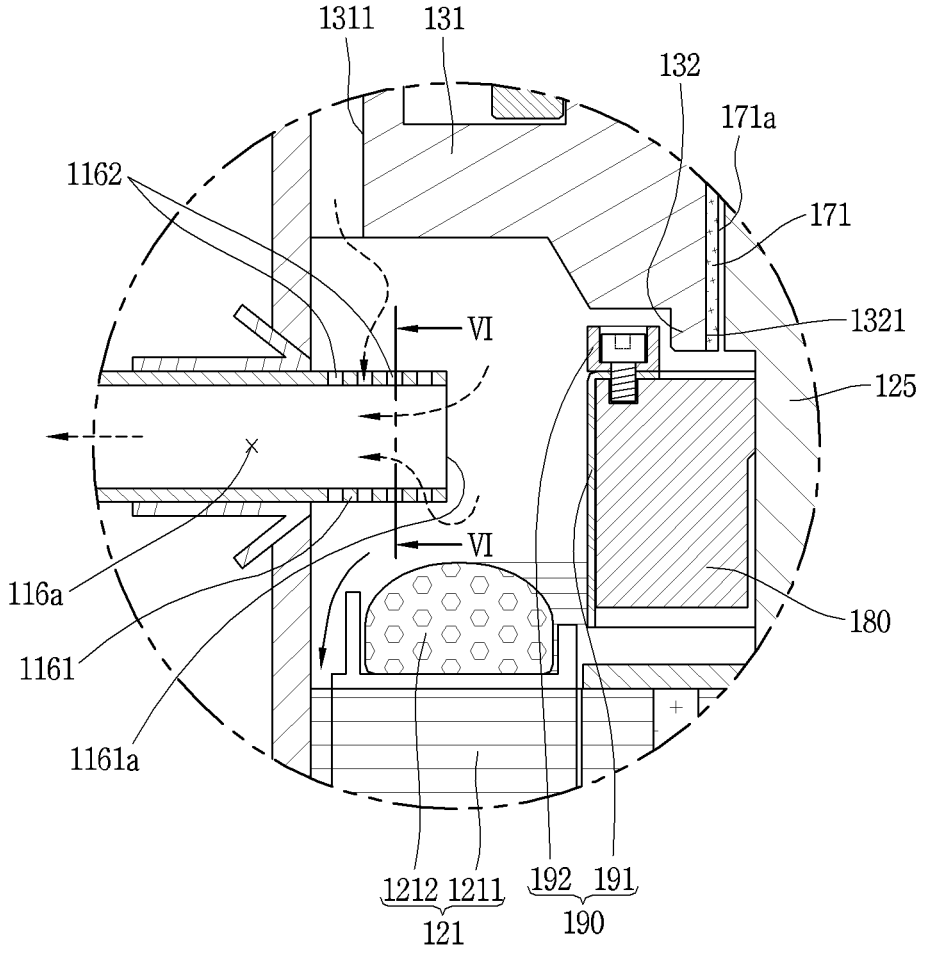
FIG. 12 is an enlarged sectional view illustrating a surrounding of the refrigerant discharge pipe in FIG. 11.
Figure 13:
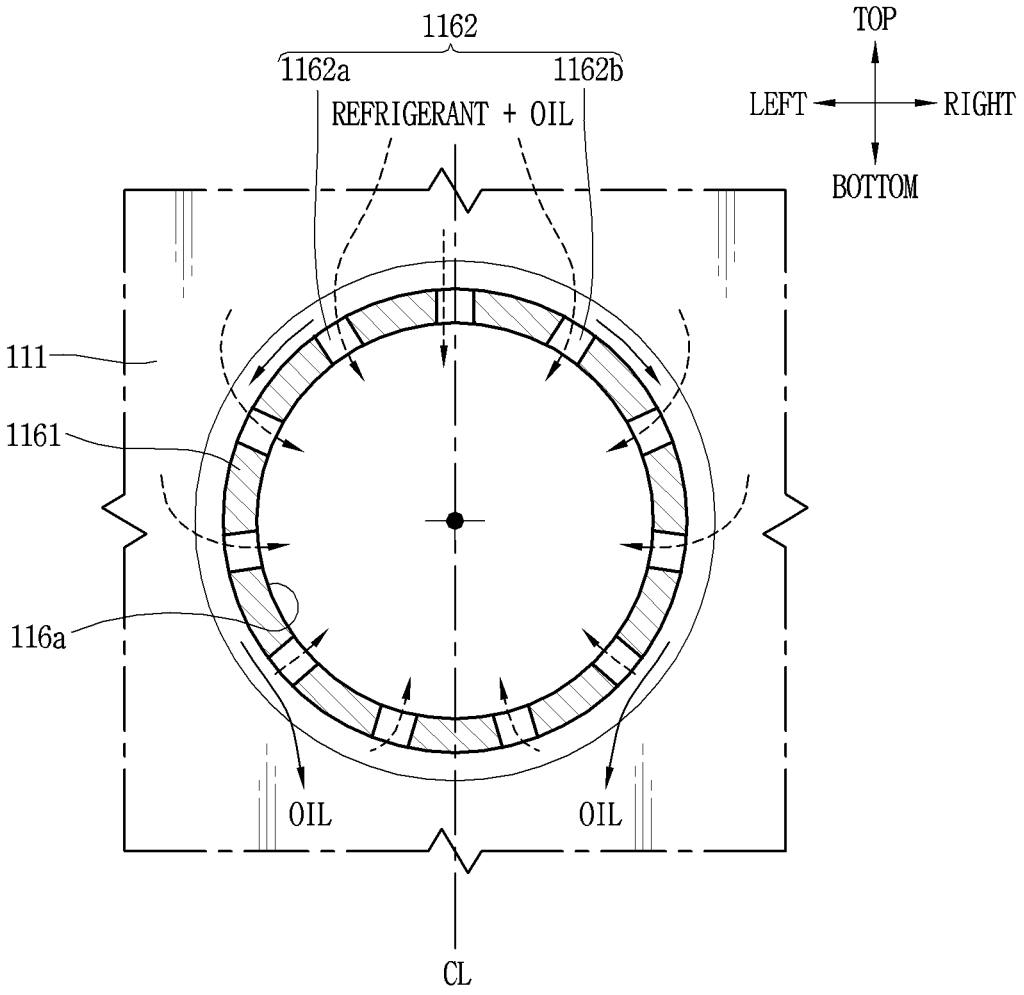
FIG. 13 is cross-sectional view taken along the line "VI-VI" of FIG. 12.
Figure 14:
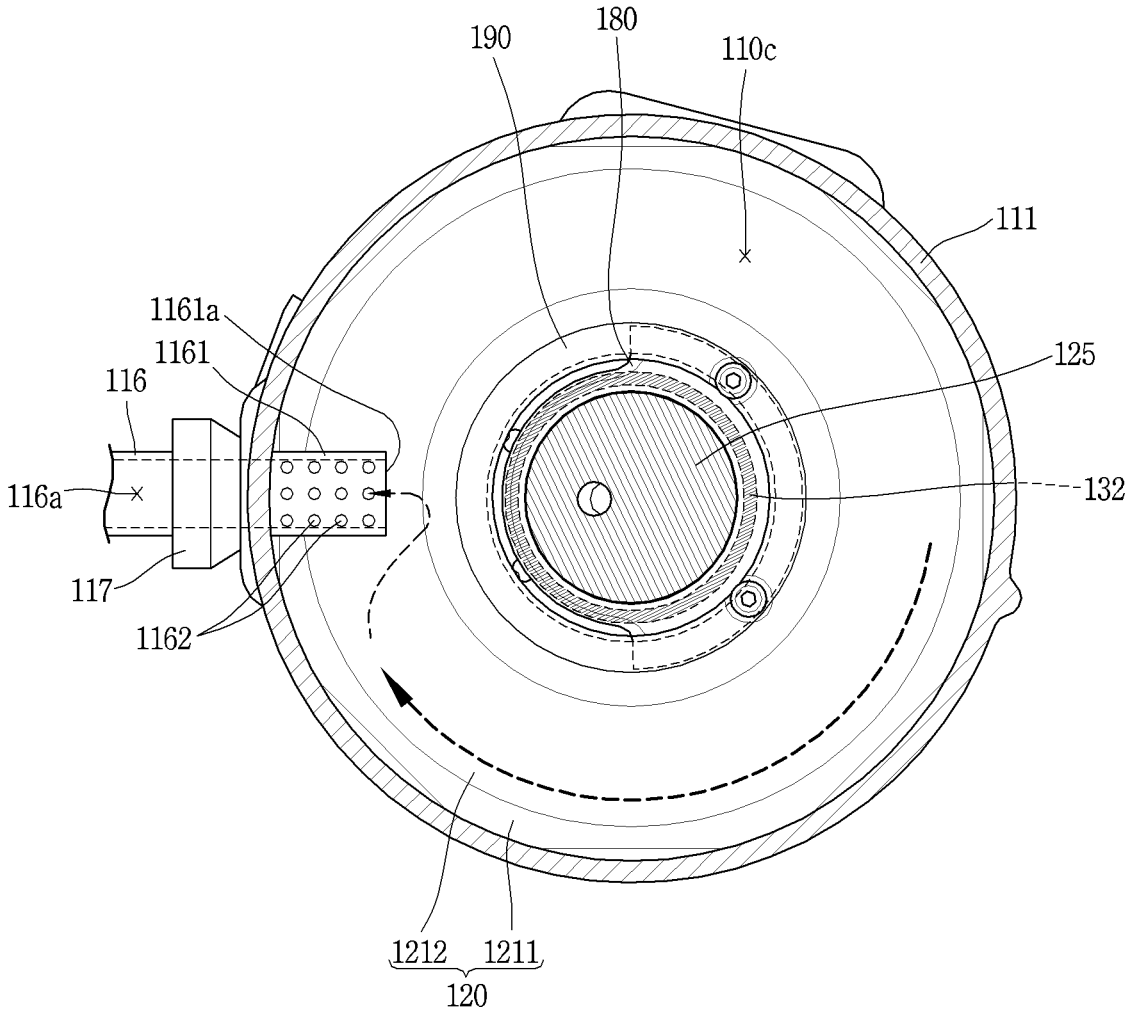
FIG. 14 is a schematic view illustrating an oil separation effect when the refrigerant discharge pipe of FIG. 11 is applied.

FIG. 11 is a cross-sectional view illustrating a part of the scroll compressor of FIG. 2 to which another example of a refrigerant discharge pipe is applied, FIG. 12 is an enlarged sectional view illustrating a surrounding of the refrigerant discharge pipe in FIG. 11, FIG. 13 is sectional view taken along the line "VI-VI" of FIG. 12, and FIG. 14 is a schematic view illustrating an oil separation effect when the refrigerant discharge pipe of FIG. 11 is applied.

Referring to FIGS. 11 to 13, the refrigerant discharge pipe 116 according to this implementation may be configured as a hollow pipe, and here may include a discharge passage portion 1162 formed at the inner accommodation portion 1161 accommodated in the inner space 110*a* of the casing 100. Accordingly, various discharge passages of refrigerant can be defined, thereby further enhancing an oil separation effect from refrigerant.

For example, the refrigerant discharge pipe 116 may include the discharge passage portion 1162 formed through a circumferential surface of the inner accommodation portion 1161. The discharge passage portion 1162 may include a plurality of discharge through holes formed through the circumferential surface of the refrigerant discharge pipe 116. The discharge passage portion 1162 may be formed in various shapes, such as a circle, an oval, or a rectangle.

The discharge passage portion 1162 may be a portion defining a sub discharge passage of the refrigerant discharge pipe 116, and may be smaller than an inner diameter of a hollow portion 116*a* defining a main discharge passage of the refrigerant discharge pipe 116. For example, a cross-sectional area of an individual discharge through hole among the plurality of discharge through holes constituting the discharge passage portion 1162 may be smaller than a cross-sectional area of the refrigerant discharge pipe 116.

Accordingly, refrigerant that has moved to the intermediate space 110*c* may partially flow into the hollow portion 116*a* of the refrigerant discharge pipe 116 through the open inner end 1161*a* of the refrigerant discharge pipe 116, and the remaining refrigerant may flow into the refrigerant discharge pipe 116 (into the hollow portion) through the discharge passage portion 1162 open through the circumferential surface of the inner accommodation portion 1161. This refrigerant can be discharged to the outside of the compressor through the refrigerant discharge pipe 116.

When the discharge passage portion 1162 is provided in plurality formed through the inner accommodation portion 1161 of the refrigerant discharge pipe 116, a total effective discharge area can increase. Referring to FIGS. 13 to 14, however, the refrigerant discharge pipe 116 may have a refrigerant passage that is made complicated due to diversified discharge passages of refrigerant. Accordingly, the refrigerant can stay in the inner space 110*a* of the casing 110 for a longer time before flowing to the refrigerant discharge pipe 116, thereby improving an oil separation effect in the compressor.

In particular, an inner diameter of the discharge passage portion 1162 may be smaller than the inner diameter of the refrigerant discharge pipe 116, which can increase flow resistance in the discharge passage portion 1162, thereby further improving the oil separation effect.

The discharge passage portions 1162 may be regularly formed along the circumferential surface. In other words, the discharge passage portions 1962 may also be formed uniformly in view of a number or cross-sectional area along the circumferential direction of the inner accommodation portion 1161. However, in consideration of a flowing direction of refrigerant, the number or cross-sectional area of the discharge passage portions 1162 may differ.

In general, the rotating shaft 125 coupled to the rotor 122 rotates in one direction in the inner space 110*a* of the casing 110. Accordingly, a refrigerant airflow is formed in one direction along a rotating direction of the rotating shaft 125 inside the inner space 110*a* of the casing 110. Therefore, the discharge passage portion 1162 may have different densities at a side facing a direction that refrigerant rotates and at an opposite side.

Figure 15:
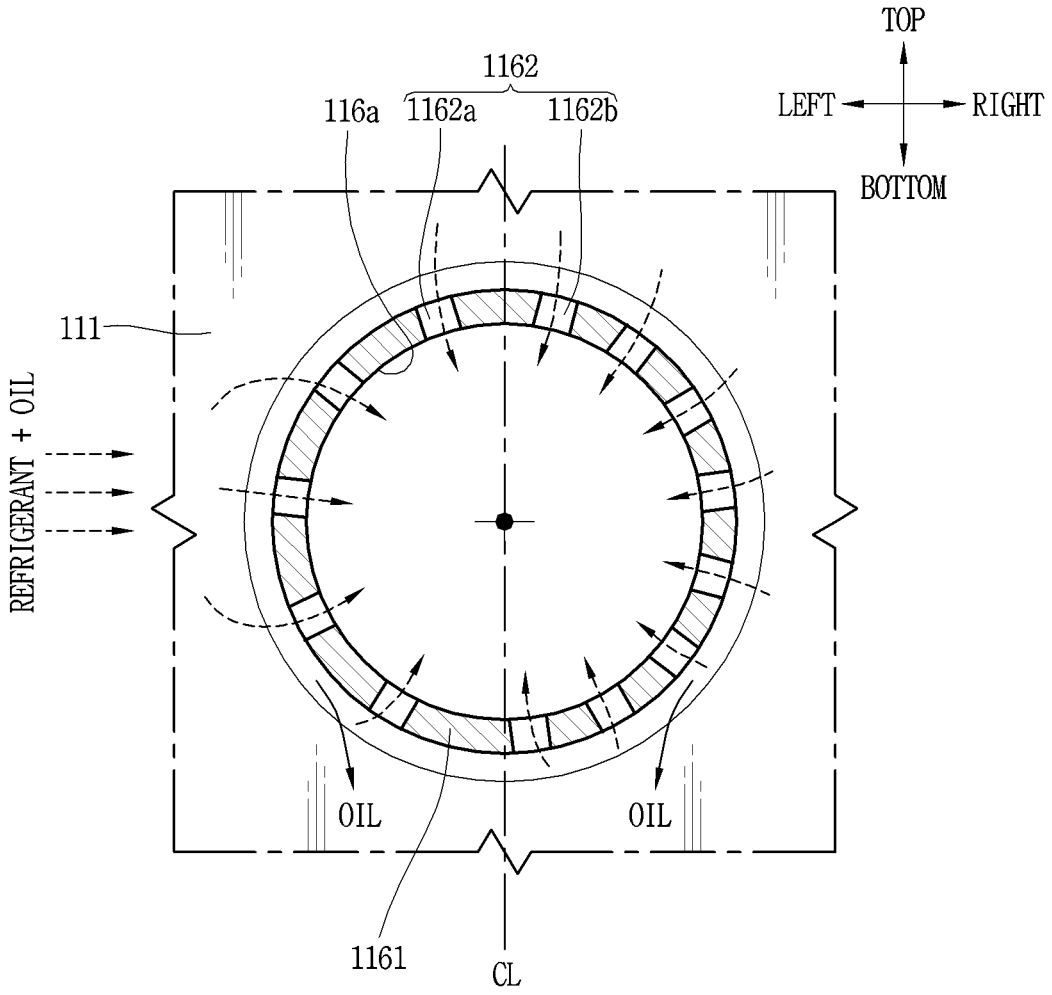
FIG. 15 is a cross-sectional view taken along the line "VI-VI" of FIG. 12 for explaining another example of a refrigerant discharge pipe.

FIG. 15 is a cross-sectional view taken along the line "VI-VI" of FIG. 12 for explaining another example of a refrigerant discharge pipe.

Referring to FIG. 15, the refrigerant discharge pipe 116 according to this implementation may include the discharge passage portion 1162 that is differently formed at both circumferential side surfaces based on an axial center line CL. Total cross-sectional areas at the both side surfaces of the discharge passage portion 1162 may be different.

Specifically, a total cross-sectional area of a first discharge passage portion 1162*a* may be smaller than a total cross-sectional area of a second discharge passage portion 1162*b*. Hereinafter, the first discharge passage portion 1162*a* may be understood as a discharge passage portion formed at a side surface (first side surface) facing a rotating direction of the rotating shaft 125, and the second discharge passage portion 1162*b* may be understood as a discharge passage portion formed at an opposite side surface (second side surface).

For example, the first discharge passage portion 1162*a* and the second discharge passage portion 1162*b* each may have a plurality of discharge through holes. The number of discharge through holes defining the first discharge passage portion 1162*a* may be smaller than the number of discharge through holes defining the second passage portion 1162*b*. Accordingly, the first discharge passage portion 1162*a* defined at the first side surface may have density that is smaller than density of the second discharge passage portion 1162*b* defined at the second side surface.

With the configuration, the first discharge passage portion 1162*a* at the first side surface of the refrigerant discharge pipe 116 and the second discharge passage portion 1162*b* at the second side surface may be formed differently. Here, in consideration of a flowing direction of refrigerant, the discharge passage portion (the first discharge passage portion) 1162*a* that directly collides with the refrigerant may be formed relatively coarser than the opposite discharge passage portion (the second discharge passage portion) 1162*b*.

Then, under a condition that an entire discharge passage including the hollow portion 116*a* defining the main discharge passage and the discharge passage portion 1162 defining the sub discharge passage has the same cross-sectional area, the refrigerant discharge passage can be more complex and diverse. This can delay a discharge time of the refrigerant, thereby further improving an oil separation effect from the refrigerant.

Hereinafter, another implementation of a discharge passage portion will be described.

That is, the previous implementation illustrates that the discharge passage portion is formed through the circumferential surface of the inner accommodation portion 1161 of the refrigerant discharge pipe 116, but in some cases, the discharge passage portion 1162 may alternatively be formed in a slit shape split at the inner end of the refrigerant discharge pipe 116 in a longitudinal direction.

Figure 16:
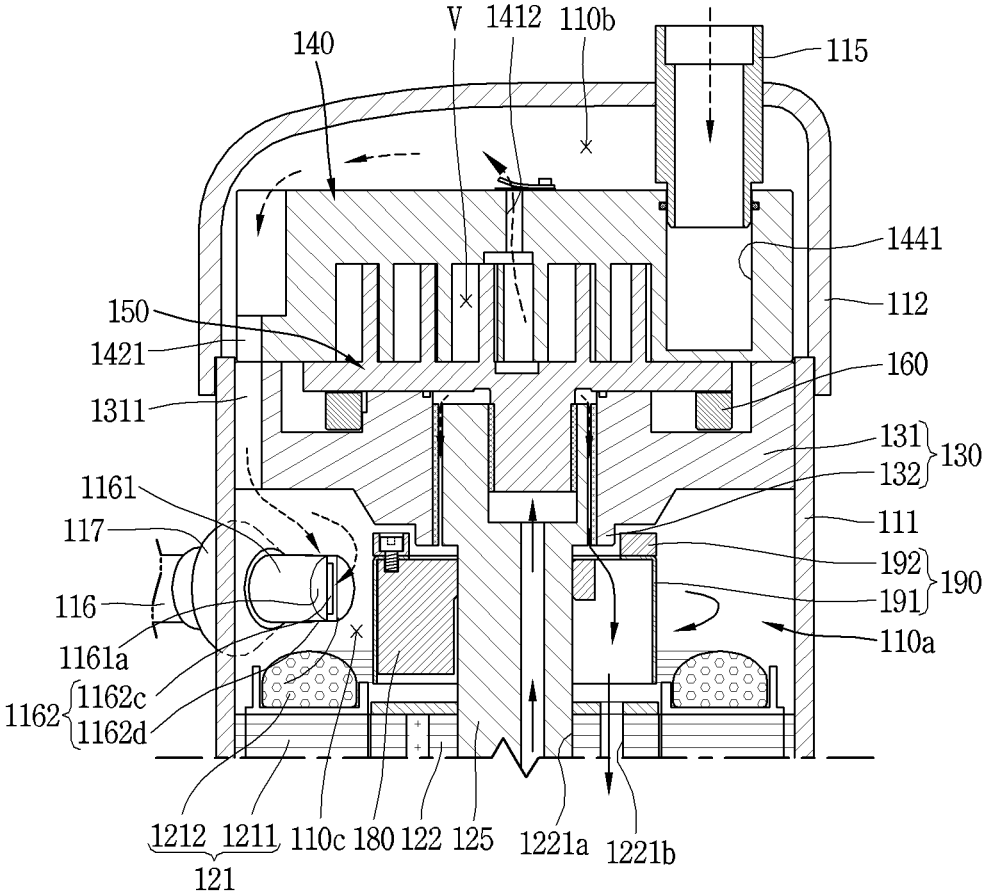
FIG. 16 is a cross-sectional view illustrating a part of the scroll compressor of FIG. 2 to which still another example of a refrigerant discharge pipe is applied.
Figure 17:
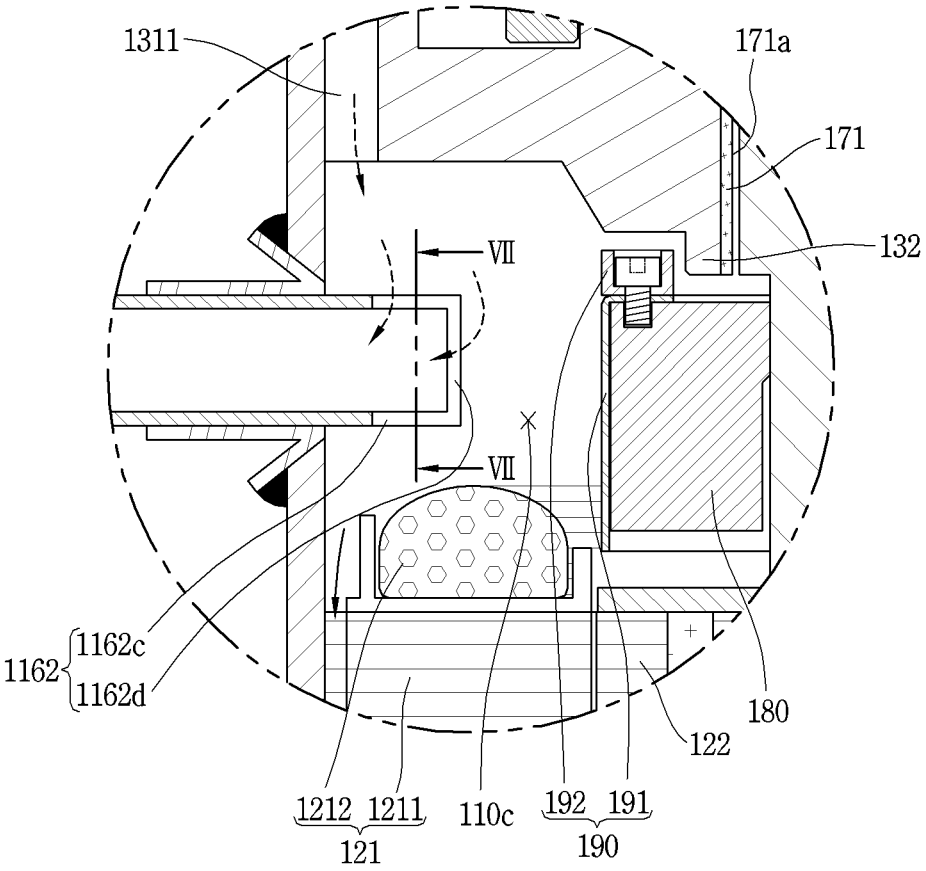
FIG. 17 is an enlarged sectional view illustrating a surrounding of the refrigerant discharge pipe in FIG. 16.
Figure 18:
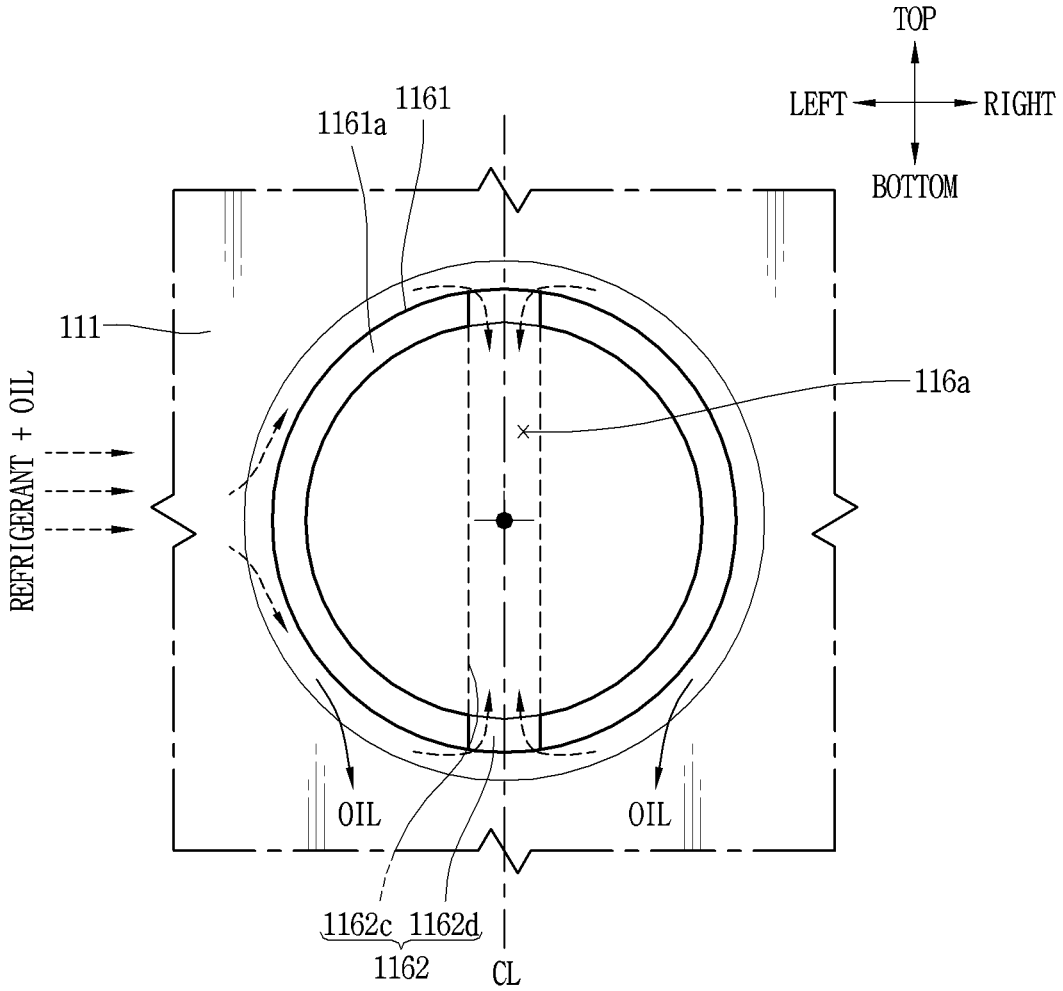
FIG. 18 is a cross-sectional view taken along the line "VII-VII" of FIG. 17.
Figure 19:
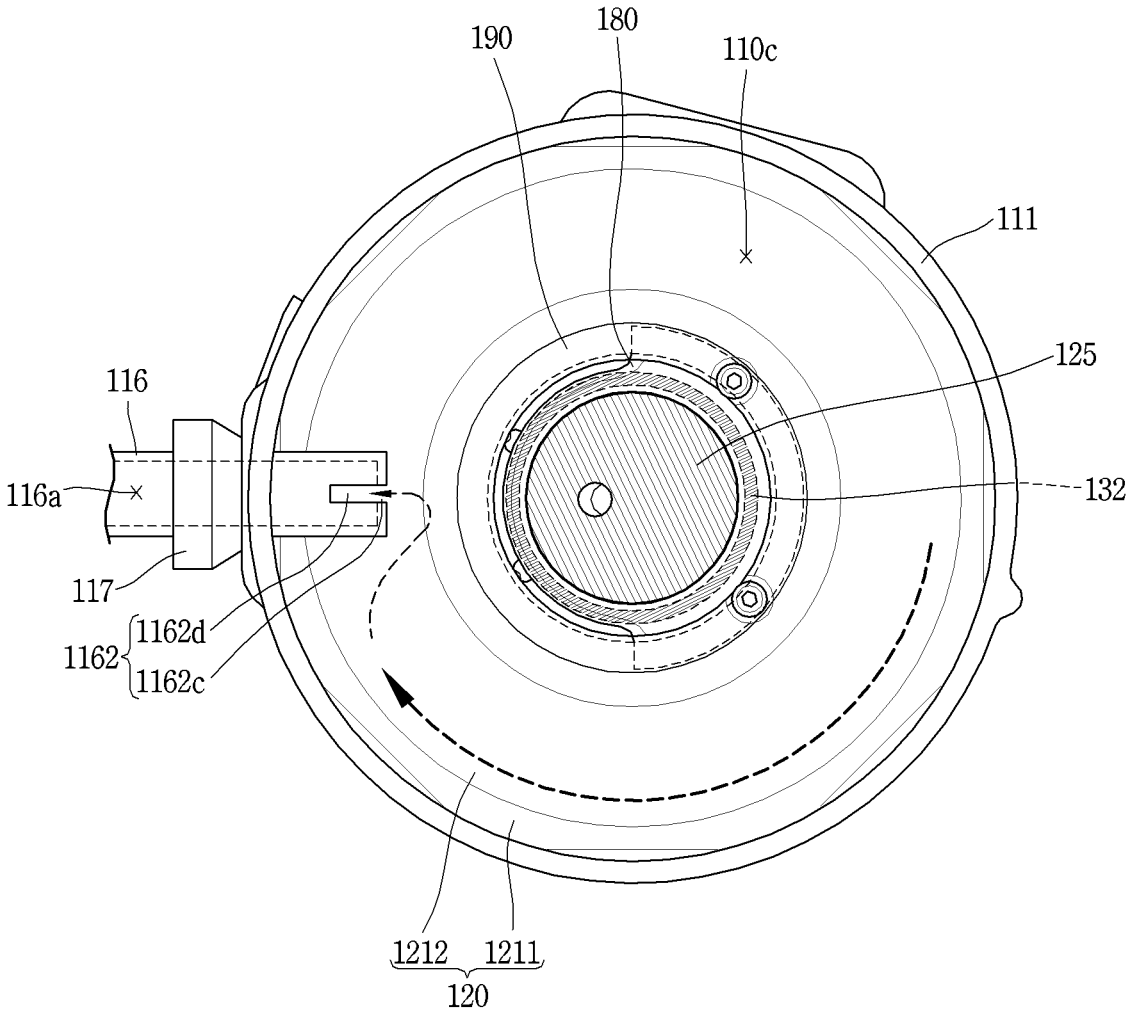
FIG. 19 is a schematic view illustrating an oil separation effect when the refrigerant discharge pipe of FIG. 16 is applied.

FIG. 16 is a cross-sectional view illustrating a part of the scroll compressor of FIG. 2 to which still another example of a refrigerant discharge pipe is applied, FIG. 17 is an enlarged sectional view of a surrounding of the refrigerant discharge pipe in FIG. 16, FIG. 18 is a sectional view taken along the line "VII-VII" of FIG. 17, and FIG. 19 is a schematic view illustrating an oil separation effect when the refrigerant discharge pipe of FIG. 16 is applied.

Referring to FIGS. 16 to 18, the refrigerant discharge pipe 116 according to this implementation may be configured, as illustrated in the foregoing implementation, such that the inner end 1161*a* of the refrigerant discharge pipe 116 is located closer to the rotating shaft 125 than the lower end of the second refrigerant guide groove 1311 defining the outlet-side end of the refrigerant guide passage. Since the operating effects are the same as those of the previous implementation, a description thereof will be omitted.

However, the discharge passage portion 1162 according to this implementation may be formed in a slit shape at the inner end 1161*a* of the refrigerant discharge pipe 116 by a preset depth along the longitudinal direction of the refrigerant discharge pipe 116. Accordingly, the inner end 1161*a* of the refrigerant discharge pipe 116 defining an end surface of the inner accommodation portion 1161 may be formed in a shape with both sides blocked with the discharge passage 1162 in their center.

The discharge passage portion 1162 may be located on an axial center line with respect to a cross-section of the refrigerant discharge pipe 116. In other words, both sides of the discharge passage portion 1162 in the circumferential direction may be symmetrically blocked. Accordingly, strength of the refrigerant discharge pipe 116 can be secured even if the discharge passage portion 1162 is formed in the slit shape at the refrigerant discharge pipe 116.

Specifically, the discharge passage portion 1162 according to this implementation may include an inner surface passage portion 1162*c* and upper and lower circumferential surface passage portions 1162*d*.

The inner surface passage portion 1162*c* may be formed through the inner end 1161*a* of the refrigerant discharge pipe 116 in the axial direction (widthwise direction), and the upper and lower circumferential surface passage portions 1162*d* may be formed in a shape radially split at the circumferential surface defining the inner accommodation portion 1161 of the refrigerant discharge pipe 116.

The inner surface passage portion 1162*c* and the circumferential surface passage portions 1162*d* may be connected to each other to form a rectangular parallelepiped shape having preset width and length. Accordingly, the refrigerant discharge pipe 116 can be formed such that both axial side surfaces (i.e., upper and lower surfaces) of the inner accommodation portion 1161 and the inner end 1161*a* of the inner accommodation portion 1161 are partially open but both circumferential side surfaces are blocked.

Referring to FIGS. 18 and 19, even when the discharge passage portion 1162 is formed in the slit shape as in this implementation, the refrigerant discharge path may become complicated so as to delay a refrigerant discharge from the inner space 110*a* of the casing 110, thereby suppressing an oil leakage in the compressor and reducing a friction loss.

In other words, even in this implementation, the discharge passage of the refrigerant can be dispersed and an area of the discharge passage per unit area can be narrowed while an effective discharge area of the refrigerant discharge pipe 116 is secured. Accordingly, flow resistance can increase with respect to the refrigerant flowing into the refrigerant discharge pipe 116, which may result in further improving an oil separation effect from the refrigerant passing through the discharge passage portion 1162 of the refrigerant discharge pipe 116.

In some implementations, the discharge passage portion 1162 may also be provided in plurality even in this implementation. In this case, the plurality of discharge passage portions 1162 may be disposed at uniform intervals. The operating effect of this implementation is similar to that in the previous implementation having the single discharge passage portion 1162 formed in the slit shape.

Hereinafter, still another implementation of a refrigerant discharge pipe will be described.

That is, the previous implementations illustrate that the refrigerant discharge pipe 116 faces the axial center O of the rotating shaft 125, but in some cases, the inner end 1161*a* of the refrigerant discharge pipe 116 may alternatively be formed to face a direction that is eccentric with respect to the axial center O of the rotating shaft 125.

Figure 20:
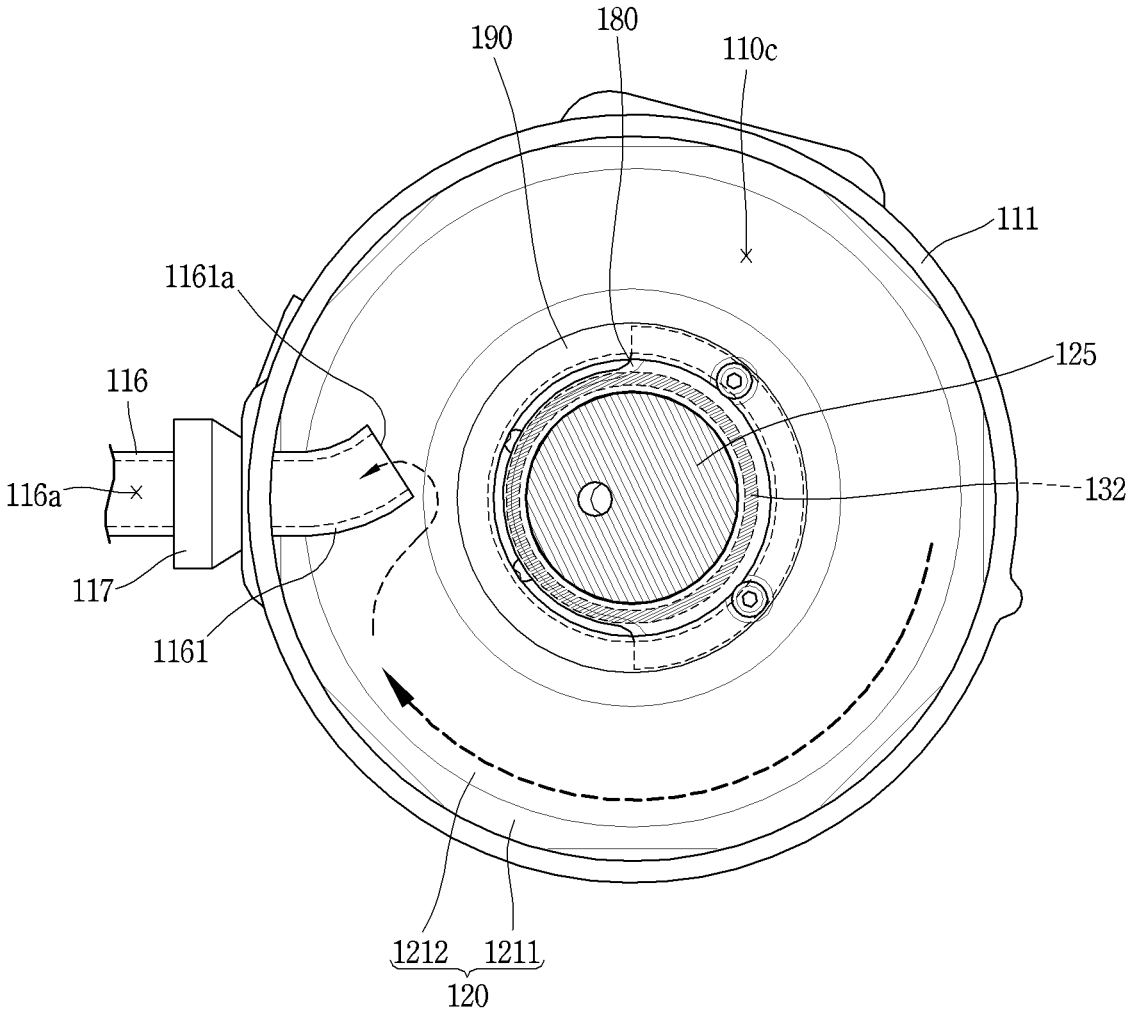
FIG. 20 is a cross-sectional view illustrating a part of the scroll compressor of FIG. 2 to which still another example of a refrigerant discharge pipe is applied.

FIG. 20 is a cross-sectional view illustrating a part of the scroll compressor of FIG. 2 to which still another example of a refrigerant discharge pipe is applied.

Referring to FIG. 20, the refrigerant discharge pipe 116 according to this implementation may be configured such that the end of the inner accommodation portion 1161, namely, the inner end 1161*a* of the refrigerant discharge pipe 116 is curved to be eccentric with respect to the axial center O of the rotating shaft 125.

For example, the refrigerant discharge pipe 116 in this implementation may be configured such that the inner accommodation portion 1161 is curved in a direction to correspond to the rotating direction of the rotating shaft 125 (that is, the inner accommodation portion is curved in a clockwise direction when the rotating shaft rotates clockwise). Accordingly, the inner end 1161*a* of the refrigerant discharge pipe 116 may lean against refrigerant flowing in the rotating direction of the rotating shaft 125.

Then, the refrigerant can turn along a curved outer circumferential surface of the refrigerant discharge pipe 116 without directly flowing into the inner end 1161*a* of the refrigerant discharge pipe 116. This can delay a discharge time of the refrigerant flowing into the refrigerant discharge pipe 116 from the inner space 110*a* of the casing 110, thereby further improving an oil separation effect from the refrigerant.

In some implementations, the refrigerant discharge pipe 116 may alternatively be formed such that the inner end 1161*a* is bent in an eccentric direction with respect to the axial center O of the rotating shaft 125. Even in this case, the operating effect is similar to that of the previous implementation.

In some implementations, the refrigerant discharge pipe 116 may be configured such that the inner accommodation portion 1161 is assembled inclinedly to face an eccentric direction with respect to the axial center O of the rotating shaft 125 even if it is formed in a linear shape. Even in this case, the refrigerant discharge pipe 116 may be formed eccentrically in a direction that corresponds to the rotating direction of the rotating shaft 125, thereby complicating the refrigerant discharge passage and thus enhancing an oil separation effect.

In some implementations, the refrigerant discharge pipe 116 may be configured such that the inner accommodation portion 1161 includes the discharge passage portion 1162 having the plurality of discharge through holes or formed in the slit shape even when the inner end 1161*a* is curved or bent. This can further improve the oil separation effect from the refrigerant.

What is claimed is:

1. A hermetic compressor, comprising:

a casing having an inner space defined therein and hermetically sealed;

a driving motor disposed in the inner space of the casing;

a rotating shaft coupled to the driving motor;

a compression unit disposed in the inner space of the casing and coupled to the rotating shaft;

a main frame disposed between the driving motor and the compression unit, the main frame comprising a shaft support protrusion that has an annular shape, that extends toward the driving motor, and that supports the rotating shaft;

a refrigerant suction pipe that passes through the casing and is coupled to the compression unit, the refrigerant suction pipe being in fluid communication with the compression unit;

a refrigerant discharge pipe that passes through the casing and is in fluid communication with the inner space of the casing;

a balance weight disposed at the rotating shaft and disposed between the driving motor and the main frame; and an oil guide that surrounds the rotating shaft and is disposed between the driving motor and the main frame, wherein the main frame and the rotating shaft are spaced apart from each other in a radial direction to thereby define a main bearing surface therebetween, wherein the oil guide is disposed radially outward relative to the shaft support protrusion and surrounds the main bearing surface, wherein the oil guide comprises an oil block that is fixed to the balance weight and extends toward the main frame, the oil block surrounding the main bearing surface, wherein the balance weight comprises:

a fixed mass portion that has an annular shape and is fixed to the rotating shaft, and an eccentric mass portion that extends from the fixed mass portion in the radial direction such that a weight of the balance weight is eccentric in the radial direction, wherein the oil block is coupled to the eccentric mass portion, and wherein an inner diameter of the oil block is less than an outer diameter of the eccentric mass portion and greater than an outer diameter of the fixed mass portion.

2. The compressor of claim 1, wherein the oil block has a first side that faces the driving motor and a second side that faces the main frame, the inner diameter of the oil block at the first side being equal to the inner diameter of the oil block at the second side.

3. The compressor of claim 1, wherein the oil block has a first side that faces the driving motor and a second side that faces the main frame, the inner diameter of the oil block at the first side being greater than the inner diameter of the oil block at the second side.

4. The compressor of claim 3, wherein the oil guide further comprises an oil guide portion that is disposed at the first side of the oil block facing the driving motor, an inner circumferential surface of the oil guide portion being stepped or inclined with respect to an inner circumferential surface of the oil block.

5. The compressor of claim 1, wherein the oil guide further comprises an oil cap that accommodates the balance weight and extends toward the driving motor.

6. The compressor of claim 5, wherein the oil cap comprises:

an oil guide portion that accommodates the balance weight; and a cap fixing portion that is bent from an upper end of the oil guide portion and fixed to the balance weight, and wherein the oil block is disposed on an upper surface of the cap fixing portion and coupled to the balance weight and the cap fixing portion.

7. The compressor of claim 6, wherein an inner diameter of the cap fixing portion is greater than or equal to the inner diameter of the oil block.

8. The compressor of claim 5, wherein the oil cap comprises:

an oil guide portion that accommodates the balance weight; and a cap fixing portion that is bent from an upper end of the oil guide portion and fixed to the balance weight, the oil block extending from the cap fixing portion.

9. The compressor of claim 1, wherein the oil guide has a cylindrical shape and surrounds the rotating shaft, the oil guide being disposed between the refrigerant discharge pipe and the main bearing surface, and wherein the oil guide is fixed to a lower surface of the main frame and extends toward the driving motor.

10. The compressor of claim 1, wherein the compression unit defines a refrigerant guide passage configured to guide refrigerant in the compression unit to the inner space of the casing, the refrigerant guide passage having an outlet-side end that is in fluid communication with a portion of the inner space of the casing that accommodates an inner end of the refrigerant discharge pipe, and wherein a radial distance between the inner end of the refrigerant discharge pipe and the rotating shaft is less than or equal to a radial distance between the outlet-side end of the refrigerant guide passage and the rotating shaft.

11. The compressor of claim 10, wherein the driving motor comprises a stator coil spaced apart from the main frame in an axial direction, and wherein the inner end of the refrigerant discharge pipe and the stator coil are arranged along the axial direction such that the inner end of the refrigerant discharge pipe overlaps with the stator coil along the axial direction.

12. The compressor of claim 10, wherein the inner end of the refrigerant discharge pipe is disposed between the driving motor and the main frame and extends toward a center axis of the rotating shaft.

13. The compressor of claim 10, wherein the inner end of the refrigerant discharge pipe is disposed between the driving motor and the main frame and extends in an eccentric direction that passes an outside of a center axis of the rotating shaft.

14. The compressor of claim 13, wherein the refrigerant discharge pipe is curved or inclined in a rotating direction of the rotating shaft.

15. The compressor of claim 14, wherein the inner end of the refrigerant discharge pipe is inclined with respect to the radial direction of the rotating shaft.

16. The compressor of claim 1, wherein the compression unit comprises:

a fixed scroll disposed on the main frame and coupled to the refrigerant suction pipe; and an orbiting scroll disposed between the fixed scroll and the main frame, the orbiting scroll being coupled to the rotating shaft and configured to rotate relative to the fixed scroll to thereby compress refrigerant, wherein the inner space of the casing comprises:

an upper space defined between an upper portion of the casing and an upper surface of the fixed scroll, and an intermediate space defined between the main frame and the driving motor, the intermediate space accommodating an inner end of the refrigerant discharge pipe, and wherein the fixed scroll and the main frame define a refrigerant guide passage configured to guide the refrigerant from the upper space to the intermediate space.

17. A hermetic compressor, comprising:

a casing having an inner space defined therein and hermetically sealed;

a driving motor disposed in the inner space of the casing;

a rotating shaft coupled to the driving motor;

a compression unit disposed in the inner space of the casing and coupled to the rotating shaft;

a main frame disposed between the driving motor and the compression unit, the main frame comprising a shaft support protrusion that has an annular shape, that extends toward the driving motor, and that supports the rotating shaft;

a refrigerant suction pipe that passes through the casing and is coupled to the compression unit, the refrigerant suction pipe being in fluid communication with the compression unit;

a refrigerant discharge pipe that passes through the casing and is in fluid communication with the inner space of the casing; and a balance weight disposed at the rotating shaft and disposed between the driving motor and the main frame;

an oil guide that surrounds the rotating shaft and is disposed between the driving motor and the main frame, wherein the main frame and the rotating shaft are spaced apart from each other in a radial direction to thereby define a main bearing surface therebetween, wherein the oil guide is disposed radially outward relative to the shaft support protrusion and surrounds the main bearing surface, wherein the oil guide comprises:

an oil cap that accommodates the balance weight and extends toward the driving motor, and an oil block that extends toward the main frame and surrounds the main bearing surface, wherein the oil cap comprises:

an oil guide portion that accommodates the balance weight, and a cap fixing portion that is bent from an upper end of the oil guide portion and fixed to the balance weight, the oil block extending from the cap fixing portion, and wherein the oil block is bent radially inward relative to an inner circumference of the cap fixing portion and axially extends toward the main frame.

18. A hermetic compressor, comprising:

a casing having an inner space defined therein and hermetically sealed;

a driving motor disposed in the inner space of the casing;

a rotating shaft coupled to the driving motor;

a compression unit disposed in the inner space of the casing and coupled to the rotating shaft;

a main frame disposed between the driving motor and the compression unit, the main frame comprising a shaft support protrusion that has an annular shape, that extends toward the driving motor, and that supports the rotating shaft;

a refrigerant suction pipe that passes through the casing and is coupled to the compression unit, the refrigerant suction pipe being in fluid communication with the compression unit;

a refrigerant discharge pipe that passes through the casing and is in fluid communication with the inner space of the casing;

a balance weight disposed at the rotating shaft and disposed between the driving motor and the main frame; and an oil guide that surrounds the rotating shaft and is disposed between the driving motor and the main frame, wherein the main frame and the rotating shaft are spaced apart from each other in a radial direction to thereby define a main bearing surface therebetween, wherein the oil guide is disposed radially outward relative to the shaft support protrusion and surrounds the main bearing surface, wherein the oil guide comprises:

an oil cap that accommodates the balance weight and extends toward the driving motor, and an oil block that extends toward the main frame and surrounds the main bearing surface, wherein the oil cap comprises:

an oil guide portion that accommodates the balance weight, and a cap fixing portion that is bent from an upper end of the oil guide portion and fixed to the balance weight, and wherein the oil block is disposed on an upper surface of the cap fixing portion and coupled to the balance weight and the cap fixing portion.

19. The compressor of claim 18, wherein an inner diameter of the cap fixing portion is greater than or equal to an inner diameter of the oil block.

* * * * *